US007565097B2

(12) United States Patent
Miller

(10) Patent No.: US 7,565,097 B2
(45) Date of Patent: Jul. 21, 2009

(54) IMAGING CARTRIDGE DRIVE HAVING ENTIRE TOOTH ENGAGEMENT

(76) Inventor: Steven Miller, 10166 66$^{th}$ St., Pinellas Park, FL (US) 33782

( * ) Notice: Subject to any disclaimer, the term of this patent is extended or adjusted under 35 U.S.C. 154(b) by 0 days.

(21) Appl. No.: 12/043,902

(22) Filed: Mar. 6, 2008

(65) Prior Publication Data

US 2008/0152383 A1 Jun. 26, 2008

Related U.S. Application Data

(60) Division of application No. 11/120,685, filed on May 3, 2005, now Pat. No. 7,373,096, which is a continuation-in-part of application No. 10/907,470, filed on Apr. 1, 2005, now Pat. No. 7,177,567, which is a continuation of application No. 10/742,323, filed on Dec. 19, 2003, now Pat. No. 7,136,608.

(51) Int. Cl.
*G03G 15/00* (2006.01)

(52) U.S. Cl. ..... 399/167

(58) Field of Classification Search ..... 399/110, 399/111, 116, 117, 159, 167
See application file for complete search history.

(56) References Cited

U.S. PATENT DOCUMENTS 6,175,706 B1 * 1/2001 Watanabe et al. ..... 399/167

* cited by examiner

*Primary Examiner*—Hoang Ngo
(74) *Attorney, Agent, or Firm*—Jesse Delcamp

(57) ABSTRACT

Provided is an improved drive mechanism for an imaging machine. A tapered surface is disposed outboard of the drive dog seat whereby a tooth of the imaging machine drive mechanism is centered and directed into the drive dog seat. The leading edge of the drive dog seat contacts the base of the imaging machine drive mechanism thus making full contact between the drive dog seat and the imaging machine drive mechanism tooth.

3 Claims, 43 Drawing Sheets

IMAGING CARTRIDGE DRIVE HAVING ENTIRE TOOTH ENGAGEMENT

CROSS REFERENCE TO RELATED APPLICATIONS

This application is a divisional of co-pending U.S. patent application Ser. No. 11/120,685 entitled: "Toner Hopper Interconnection," filed May 3, 2005 which is a continuation-in-part to U.S. patent application Ser. No. 10/907,470 entitled: "Integrated Toner Cartridge with Toner Agitator and Sensing Device," filed Apr. 1, 2005, now U.S. Pat. No. 7,177,567, which is a continuation of U.S. patent application Ser. No. 10/742,323 entitled: "Removable Toner Cartridge Universal Adapter," filed Dec. 19, 2003, now U.S. Pat. No. 7,136,608.

BACKGROUND OF THE INVENTION

Laser printers use a coherent beam of light, hence the term "laser printer," to expose discrete portions of an image transfer drum thus attracting the printing toner. Toner is a mixture of pigment (most commonly black) and plastic particles. The toner becomes electro-statically attracted to exposed portions of the image transfer drum. The toner is transferred to paper, or other medium, as it passes over the rotating image transfer drum. Subsequently, the paper is heated so that the plastic is melted thereby permanently affixing the ink to the paper.

The vast majority of commercially available desktop laser printers include replaceable or removable toner cartridges that incorporate an image transfer drum, a toner tank, and a metering system. A drive mechanism is connected to the drum and metering system. Modern toner cartridges often include a variety of sensors that interact with the laser printer to indicate the status of the cartridge. Indications relating to toner level, print quality and general cartridge function are often included as well. A large number of types and sizes of toner cartridges are currently available. The sensing system typically includes an encoder wheel interconnected with a rotating agitating paddle within a cylindrical toner tank. Movement of the agitating paddle feeds toner into the metering system. The encoder wheel reports the movement of the agitating paddle wheel through the toner reservoir.

Certain printers in the electro-photography industry have only been able to receive a removable toner cartridge consisting of two assemblies; a hopper, and a waste bin. Previous attempts in the prior art addressed the requirement of this dual assembly by adopting a design that required the respective parts be joined together with dynamic biasing means, such as springs. Such dynamic biasing means disposed between the respective elements are prone to failure, rendering the cartridge apparatus inoperable. Therefore, what is needed is a removable toner cartridge that holds the hopper and the waste bin together without the use of a dynamic biasing means disposed between the respective parts, thereby eliminating the potential of failure inherit in the printers of the prior art.

SUMMARY OF INVENTION

The long-standing but heretofore unfulfilled need for a toner cartridge that is adapted to be of an simplified construction, thereby limiting the number of elements required during manufacture, and which also includes improvements that overcome the limitations of prior art toner cartridges is now met by a new, useful, and non-obvious invention.

In one embodiment, the present invention includes a toner cartridge adapted to fit within a toner cartridge-receiving cavity of a printer, comprising a waste bin positioned at a leading end of the toner cartridge and a hopper connected to the waste bin at a trailing end of the waste bin. A securing means connects the trailing end of the waste bin and the trailing end of the hopper to one another in a non-pivotal interconnection whereby no member is required between the waste bin and the hopper when the waste bin and the hopper are assembled.

The present invention further comprises a latching means for interconnecting the waste bin and the hopper to one another in a non-pivotal interconnection. The latching means includes the securing means having an upper retaining surface formed integrally with the trailing end of the hopper. The securing means further includes a lower retaining shelf formed integrally with the trailing end of the hopper and a contoured receiving surface formed integrally with the trailing end of the waste bin. A receiving shelf is formed integrally with the trailing end of the waste bin. The upper retaining surface and the lower retaining shelf are disposed in cooperative relation to one another and are adapted to engage the trailing end of the waste bin. When assembled the waste bin is held above the hopper so that the upper retaining surface and the lower retaining shelf are positioned directly below the contoured receiving surface and the receiving shelf and the waste bin is lowered until the upper retaining surface is engaged by the contoured receiving surface and the lower retaining shelf is engaged by the receiving shelf.

In another embodiment the toner cartridge of the present invention includes a hopper pin horizontal retainer formed integrally with the waste bin as part of the latching means. The latching means further includes a hopper pin vertical lock formed integrally with the waste bin. The hopper pin retainer and the hopper pin vertical lock are disposed in cooperative relation to one another and are adapted to engage a hopper pin that forms a part of the hopper. To assemble the toner cartridge, the waste bin is held above the hopper so that the hopper pin horizontal retainer and the hopper pin vertical lock are positioned directly above the hopper pin. The waste bin is then lowered until the hopper pin is engaged by the hopper pin horizontal retainer and the hopper pin vertical lock.

The hopper pin horizontal retainer has an upwardly inclined surface, a concavity, and a hump between the upwardly inclined surface and the concavity. The hopper pin engages the upwardly inclined surface and causes the hopper pin horizontal retainer to momentarily deflect from its position of repose when the waste bin is lowered with respect to the hopper. When the hopper pin rolls over the hump the resiliency of the hopper pin horizontal retainer causes the hopper pin horizontal retainer to return to its position of repose, thereby capturing the hopper pin in the concavity.

The hopper pin simultaneously causes the hopper pin vertical lock to deflect away from its position of repose. The hopper pin vertical lock has a straight construction and a hook formed at a free leading end thereof. The vertical lock returns to its position of repose, thereby capturing a bottom of the hopper pin when the hopper pin clears the hook. Accordingly, the hopper pin is captured on a trailing side thereof by the concavity and on its bottom side by the hook.

In an alternate embodiment, the hopper pin vertical locks have a straight configuration and a hook formed in a free end thereof. The hopper pin vertical lock are formed in depending relation to a preselected sidewall of the waste bin.

An aperture is formed in each sidewall of the waste bin near a trailing end thereof. Each aperture is adapted to receive an extension arm that forms a part of the hopper when the waste bin is lowered onto the hopper to interconnect the waste bin and hopper together, the extension arms enter into their respective apertures.

The instant invention also includes a developer roller preserver having wedged surfaces at its distal ends. The wedged surfaces removably engage the extension arms thereby displacing the extensions arms in relation to its position of repose within the aperture. The displacement of the extension arms forces the hopper to move rearward with respect to the waste bin. The resulting rearward movement of the hopper in relation to the waste bin forces the developer roller from contact with the photoconductive drum.

Another embodiment of the present invention includes at least one electrically conductive contact point disposed within the outer wall of the cartridge. A first conductive element is placed in electrical contact between a conductive contact point and the shaft of the toner adder roller. A second conductive element is placed in electrical contact between a conductive contact point and the shaft of the developer roller. Finally, a third conductive element is placed in electrical contact between a conductive contact point and the surface of the doctor bar. The at least one conductive contact point generally is a plate constructed from an electrically conductive material.

In one embodiment, the first and second conductive elements are filaments comprising a receptacle adapted to engage the shaft of the toner adder roller. In a general embodiment, the third conductive element is a blade equipped with a wire. In an alternate embodiment the first and second conductive elements are springs adapted to receive the shaft of the toner adder roller at one end.

In yet another embodiment the at least one electrically conductive contact point is disposed within the outer wall of the cartridge and the toner adder roller and developer rollers have electrically conductive shafts which extend to contact the electrically conductive contact point.

In yet another embodiment the novel toner cartridge is adapted to fit within a toner cartridge-receiving cavity of a printer and comprises a drive dog integral with one end of the developer roller, a sifting agitator having a cam pin at one end, and a cam gear having a high surface and a low surface disposed at a first end of the sifting agitator such that rotation of the gear alternately engages and disengages the cam pin of the sifting agitator. An idler gear meshingly engages with the drive dog and a toner adder roller gear integral with one end of the toner adder roller and meshingly engages with the idler gear and the cam gear. A compound idler gear meshingly engages with the cam gear and a beater drive gear integral with the shaft of the toner beater meshingly engages with the compound idler gear.

A gear plate is adapted to receive the shaft of the developer roller, the shaft of the toner adder roller, and the cam pin of the sifting agitator therethrough. The gear plate further comprises an axle adapted to receive the idler gear and an axle adapted to receive the cam gear.

A drive dog for use with a toner cartridge adapted to fit within a toner cartridge-receiving cavity of a printer, comprises at least one drive dog seat disposed along an axis of the drive dog adapted to receive a tooth of the printer drive mechanism. A tapered outboard tooth guide is disposed along the circumference of the drive dog and at least one tapered radius tooth guide is adjacent the tapered outboard tooth guide whereby a tooth of the printer drive mechanism is centered and directed into the drive dog seat.

Another embodiment of the novel drive dogs includes at least one drive dog seat disposed along the axis of the drive dog adapted to receive a tooth of the printer drive mechanism and at least one external ramp disposed along the outer perimeter of the drive dog whereby a tooth of the printer drive mechanism is centered and directed into the drive dog seat. In this embodiment the drive dog is substantially square. Yet another embodiment of the novel drive dogs comprises at least one drive dog seat elevated above the planar surface of the drive dog and disposed along an axis of the drive dog adapted to receive a tooth of the printer drive mechanism. At least one internal ramp radiates from the center of the drive dog whereby a tooth of the printer drive mechanism is centered and directed into the drive dog seat. The drive dog in this embodiment is substantially circular.

In yet another embodiment a drive dog for use with a toner cartridge adapted to fit within a toner cartridge-receiving cavity of a printer, comprises at least one drive dog seat disposed along the circumference of the drive dog and a centering cone disposed on the drive dog whereby a tooth of the printer drive mechanism is centered and directed into the drive dog seat. The drive dog in this embodiment is substantially circular fustroconical.

The toner cartridge adapted to fit within a toner cartridge-receiving cavity of a printer, comprises, in another embodiment, a rotatable photoconductive drum having a central aperture therethrough wherein a pair of drum studs rotatably connect the drum to the cartridge. The drum studs are unobstructed for locating the cartridge in the printer. To protect the photoconductive drum an opaque door hingidly mounts within the cartridge in overlying relation to the photoconductive drum. Protrusions are disposed on the upper surface of the opaque door for engaging the host printer whereby the engagement forces the door into an open position. A stationary surface fixedly connects to the toner cartridge and a moveable surface hingidly connects to the stationary surface. The moveable surface is hingidly connected to the stationary surface by a hinge constructed from a material having memory characteristics.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

In a general embodiment the novel toner cartridge has a photoconductive drum on which an electrostatic image is formed. The photoconductive drum rotates in a plane perpendicular to that of the print medium passing through the toner cartridge. A recovery blade is placed in direct contact with the photoconductive drum. During the imaging stage, the photoconductive drum is exposed to light, usually a laser, which imprints a latent image thereon. A developing roller converts the electrostatic-image into a toner-image. Toner is then transferred to the print medium by means of static electricity, an opposite polar charge on the print medium, established by a transfer roller. The recovery blade then scrapes the waste toner from the photoconductive drum and directs it to the waste bin.

Construction of the Novel Toner Cartridge

Figure 1A:
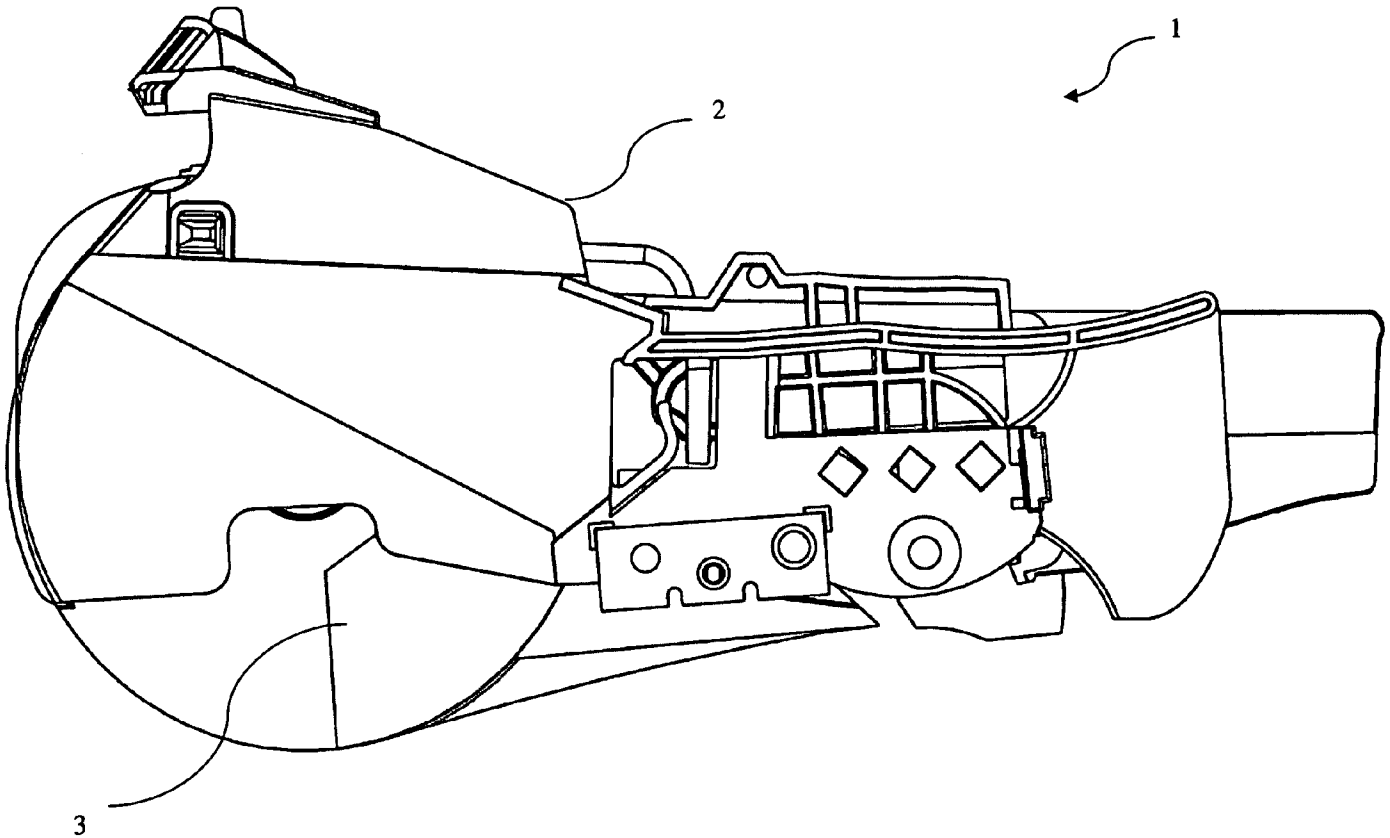
FIG. 1A is a side elevational view of the driven side of the novel toner cartridge.

Referring now to FIG. 1A, it will there be seen that the reference numeral 1 denotes an illustrative embodiment of the novel toner cartridge as a whole. Novel toner cartridge 1 is made by interconnecting waste bin 2 of FIGS. 1B and 2 to hopper 3 of FIGS. 1C and 3 to one another. More particularly, as suggested by the alignment of parts in FIGS. 1B and 1C, trailing end 2*a* of waste bin 2 is positioned over hopper 3 and said waste bin is then lowered until said two parts are interconnected. The details of how the interconnection is accomplished are disclosed more fully hereinafter.

Hopper pin 64 (FIG. 3) is integral with the side walls of the leading end of hopper 3 and mate with hopper pin horizontal retainer 70 and hopper pin vertical lock 72 (discussed more fully below). Hopper pin 64 includes rounded surface 64*a*, formed at a trailing end thereof, upper locating surface 64*b*, and lower locating surface 64*c*. The unique shape of hopper pin 64 helps to lock hopper 3 in place in waste bin 2. Upper locating surfaces 64*b* and lower locating surfaces 64*c* aid in locating hopper 3 vertically in novel waste bin 2 whereas curved surface 64*a* serve to locate hopper 3 horizontally.

Torque tab 43 extends outward from curved surface 64*a* of hopper pin 64 on the driven side of hopper 3. Torque tab 43 contacts the inner sidewall of the driven side of waste bin 2, thereby securing hopper 3 from moving laterally when force is applied from the printer drive mechanism.

A first embodiment of the novel latching means for interconnecting waste bin 2 and hopper 3 to one another without the use of a dynamic biasing element is best illustrated in FIGS. 5A-B and 6A-B.

Figure 1B:
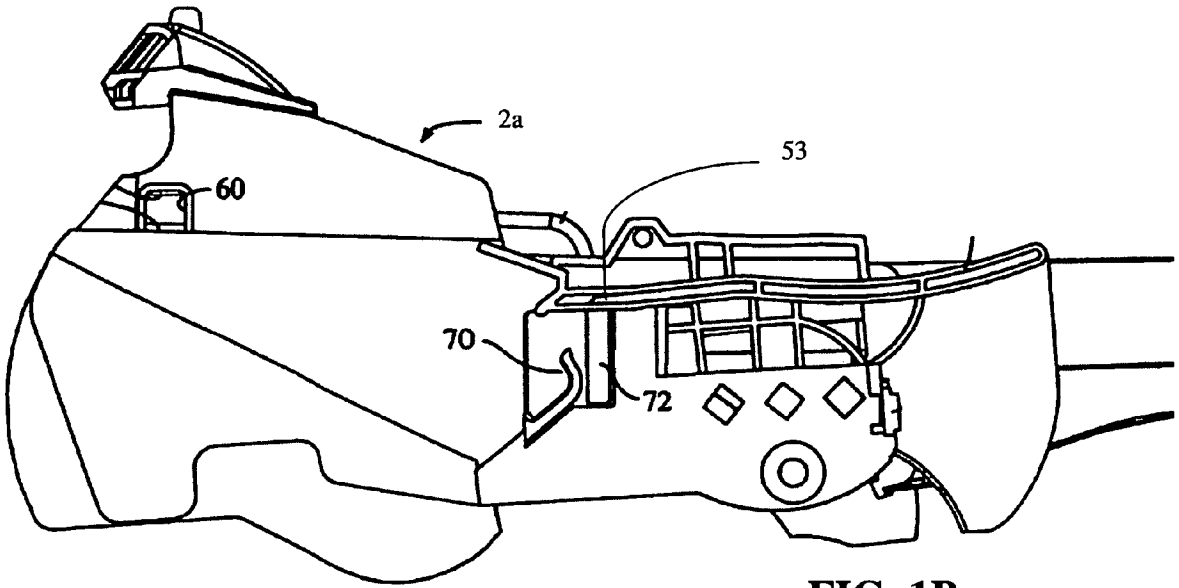
FIG. 1B is a side elevational view of the driven side of the waste bin of the novel toner cartridge.
Figure 1C:
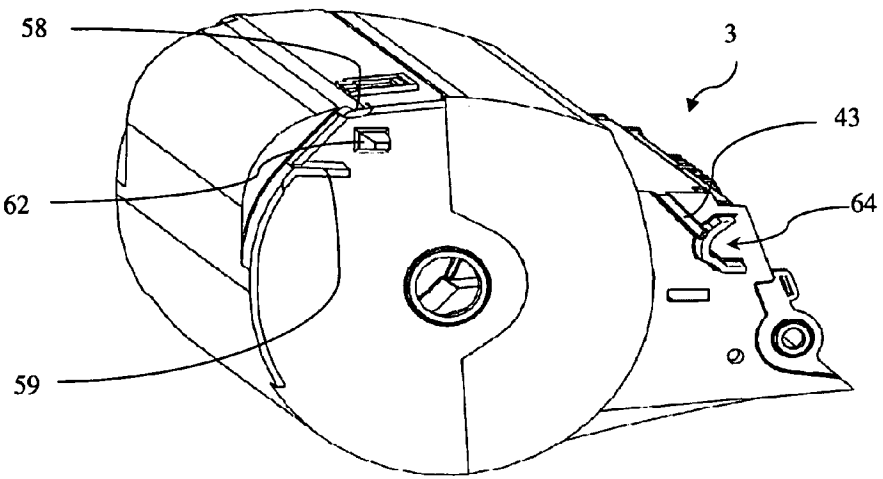
FIG. 1C is a perspective view of the driven side of the hopper of the novel toner cartridge.
Figure 2:
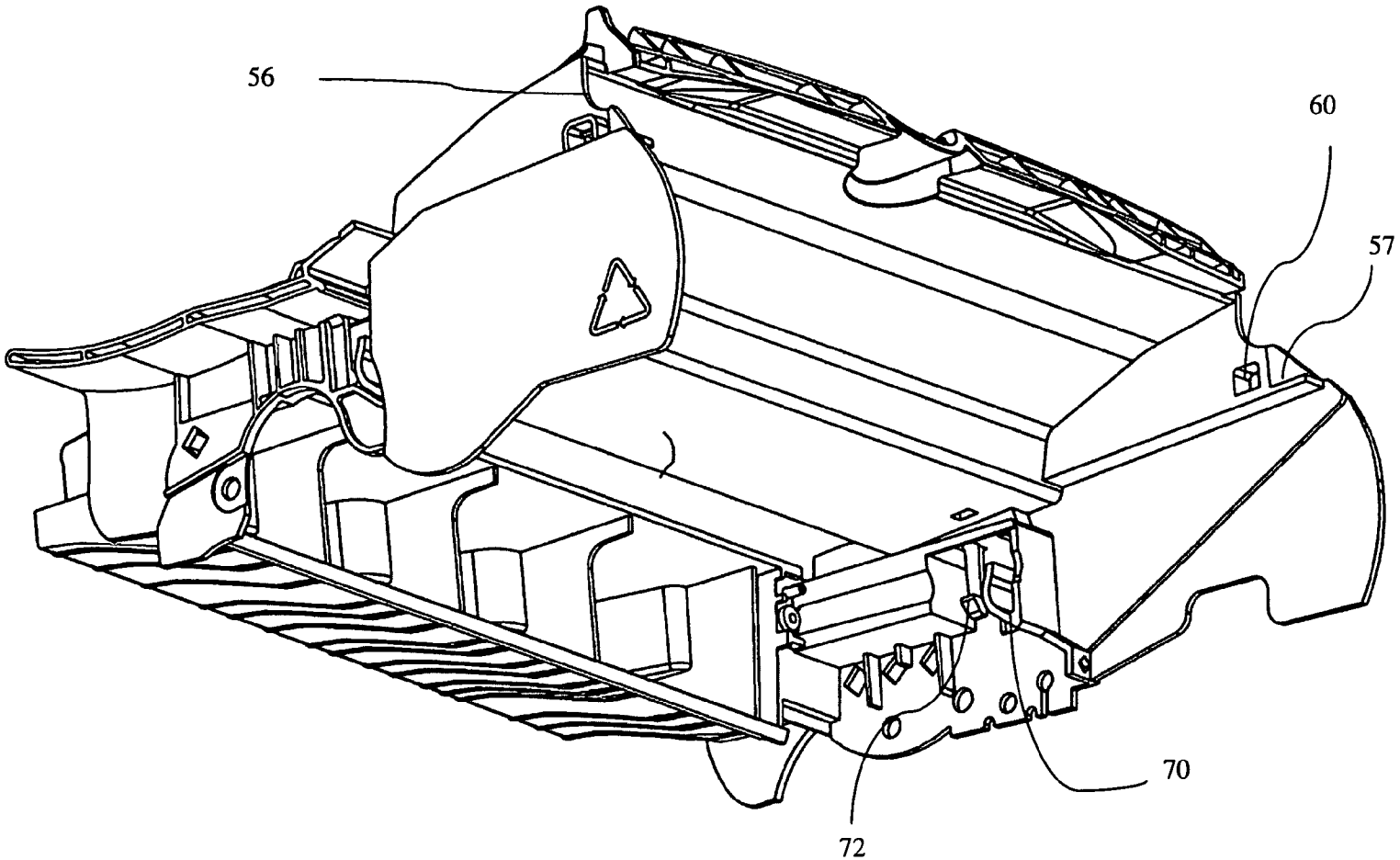
FIG. 2 is a perspective view of the waste bin of the novel toner cartridge.
Figure 3:
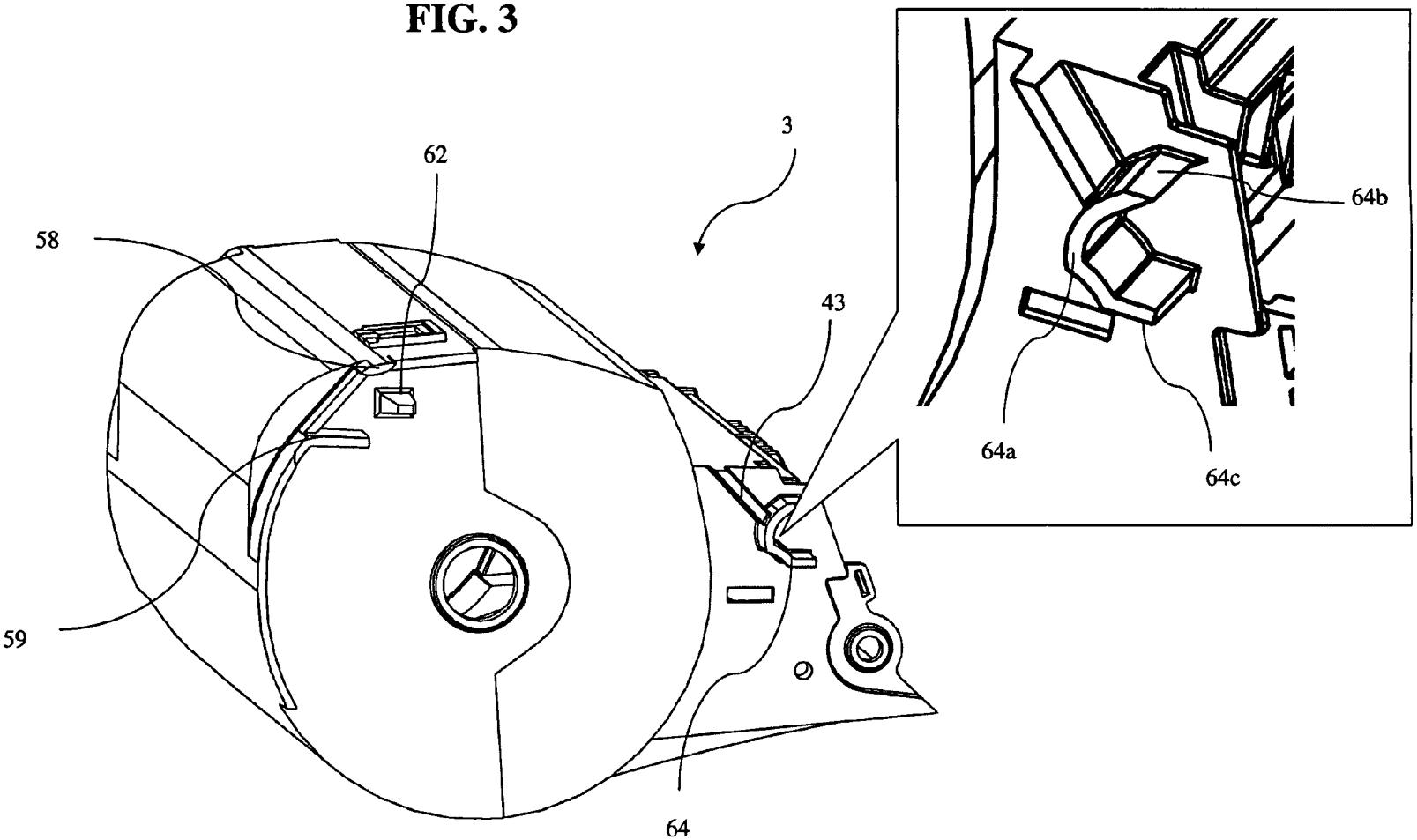
FIG. 3 is a perspective view of the driven side of the hopper of the novel toner cartridge.

Hopper pin horizontal retainer 70 and hopper pin vertical lock 72 are formed integrally with waste bin 2 and cooperate with one another to engage hopper pin 64 FIG. 3 as best understood in connection with FIGS. 1B and 1C.

When hopper pin 64 is engaged in horizontal retainer 70 and hopper pin vertical lock 72, its captured position dictates the elevation of the rear of planar wing 53 as depicted in FIG. 1B. Horizontal retainer 70 exerts an upward force on curved surface 64*a* of hopper pin 64, causing upper locating surface

Figure 4A:
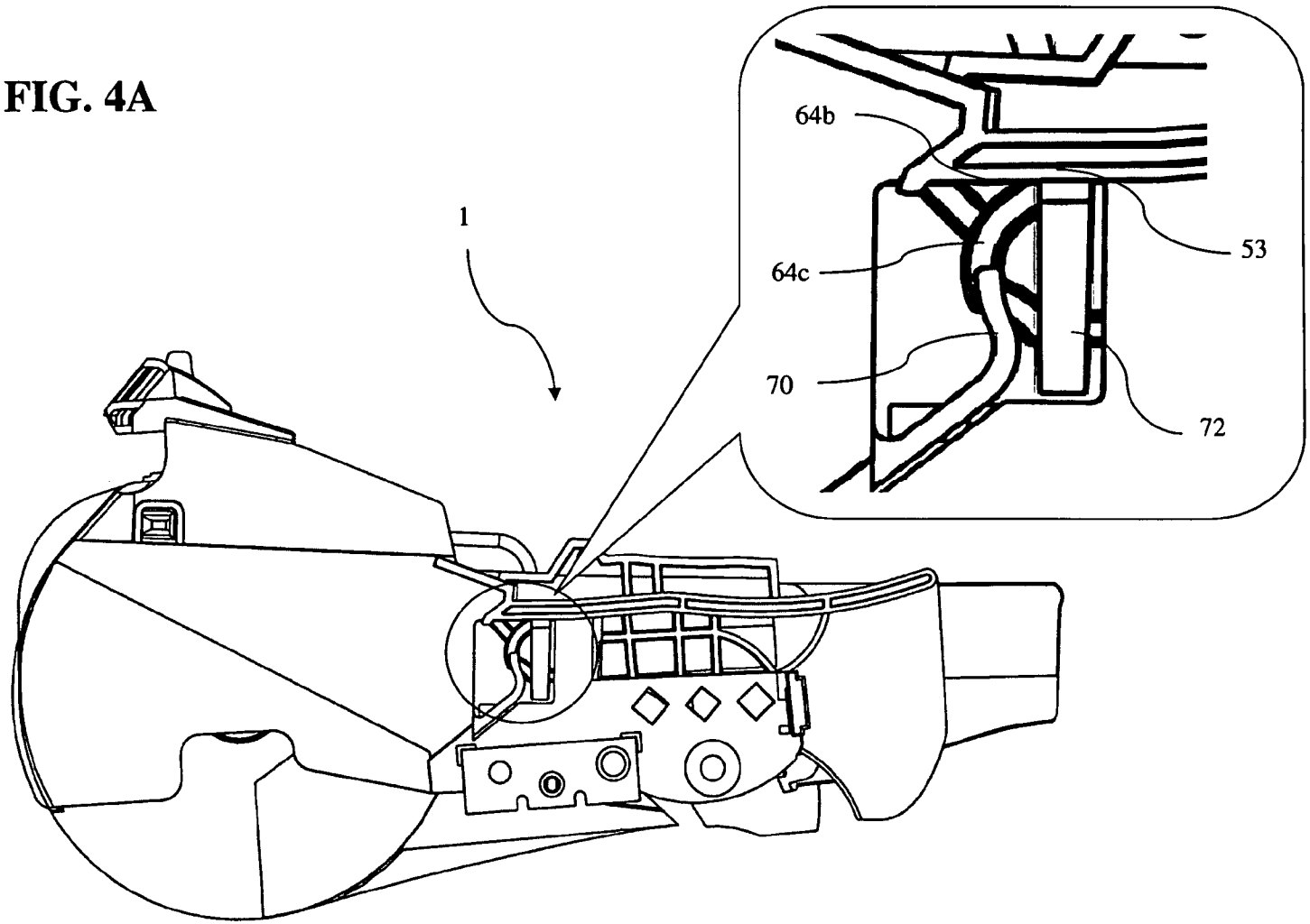
FIG. 4A is a detailed perspective view of the latching means of the novel toner cartridge.

64*b* to make snug contact at a point on the bottom side of level planar wing 53 (FIG. 4A). Such snug contact ensures proper alignment and orientation of cartridge components when the cartridge is installed into and removed from the printer. The leveling of the planar wing provides for a smoother glide over printer guides during installation of the cartridge into and removal of the cartridge from the printer.

The trailing end of hopper 3 is held against pivotal movement relative to waste bin 2 by lower retaining shelves 59 (FIG. 3) disposed near the upper end of hopper 3. Upper retaining surface 58 extends outward from the upper surface of hopper 3 at a point above lower locating shelf 59. When engaged with mating surfaces on waste bin 2, lower retaining shelves 59 secure hopper 3 from upward movement, relative to waste bin 2, whereas upper retaining surfaces 58 secure hopper 3 from downward movement, relative to waste bin 2. In this manner hopper 3 and waste bin 2 are held against pivotal movement relative to one another.

Figure 4B:
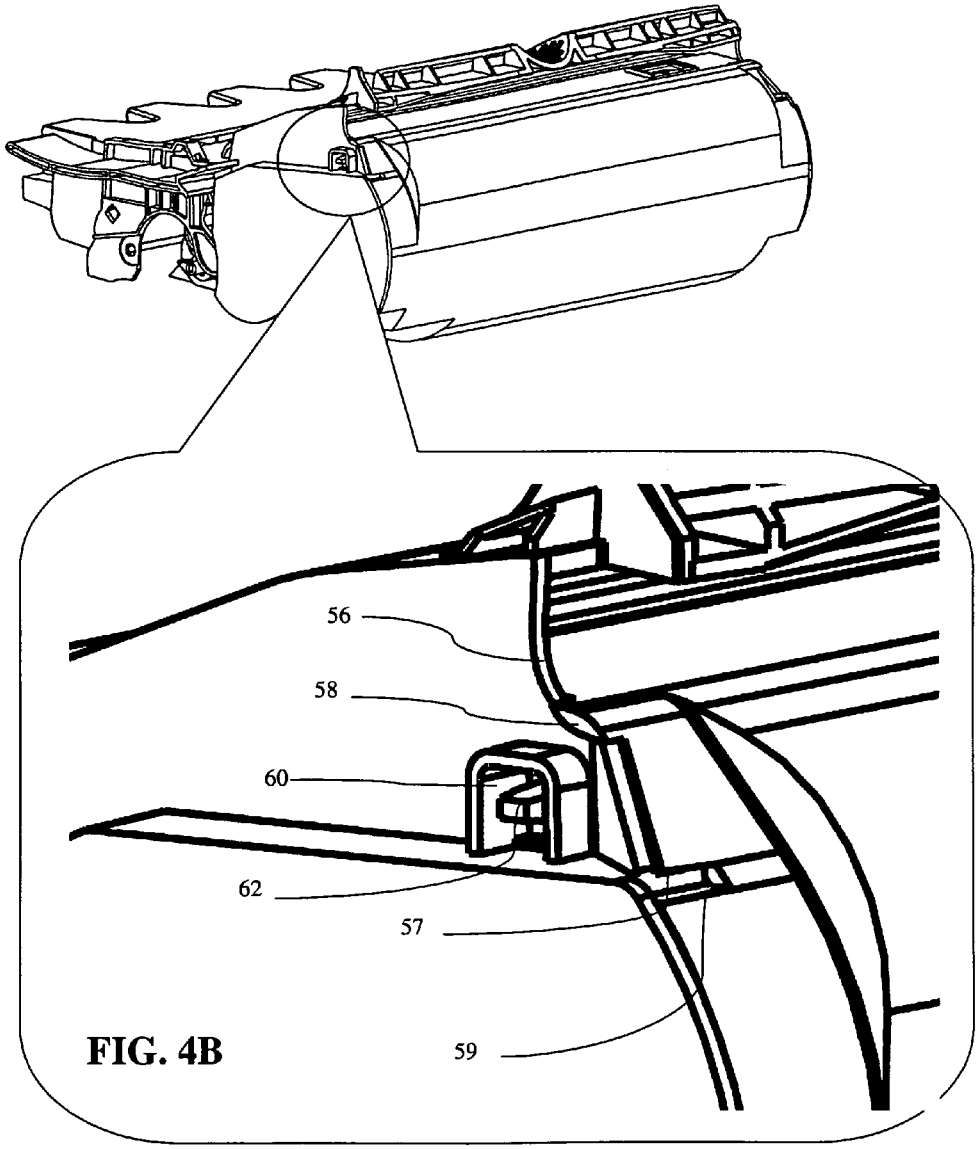
FIG. 4B is a detailed perspective view of the securing means of the novel toner cartridge.

Receiving shelves 57 (FIG. 2) are disposed at the trailing end of waste bin 2 and mate on their lower surfaces with lower retaining shelves 59 to secure hopper 3 from upward movement, relative to waste bin 2 as shown in FIG. 4B. Contoured receiving surfaces 56, located along the trailing wall of waste bin 2 at some point above receiving shelves 59, engage upper retaining surfaces 58 on the upward face of the contoured receiving surfaces. When the lower surface of upper retaining surface 58 engages the upward facing surface of contoured surface 56 of waste bin 2, hopper 3 is held in place against downward movement, relative to waste bin 2. These mating surfaces prevent the movement that would otherwise exist as a result of the pivot-point created by hopper pin 64.

To assemble novel toner cartridge 1, waste bin 2 is held above hopper 3 as mentioned earlier in connection with FIGS. 1A-C so that hopper pin horizontal retainer 70 and hopper pin vertical lock 72 are positioned directly above hopper pin 64. As waste bin 2 is lowered, upper locating surface 64*b* (FIG. 3) of hopper pin 64 engages upwardly inclined surface 70*a* (FIGS. 5A-B) of horizontal retainer 70 and causes horizontal retainer 70 to deflect from its FIGS. 5A-B position of repose. Curved surface 64*a* of hopper pin 64 slides over hump 70*b* and the resiliency of horizontal retainer 70 causes it to move back toward its position of repose, thereby capturing curved surface 64*a* of hopper pin 64 in concavity 70*c*.

Figure 5A:
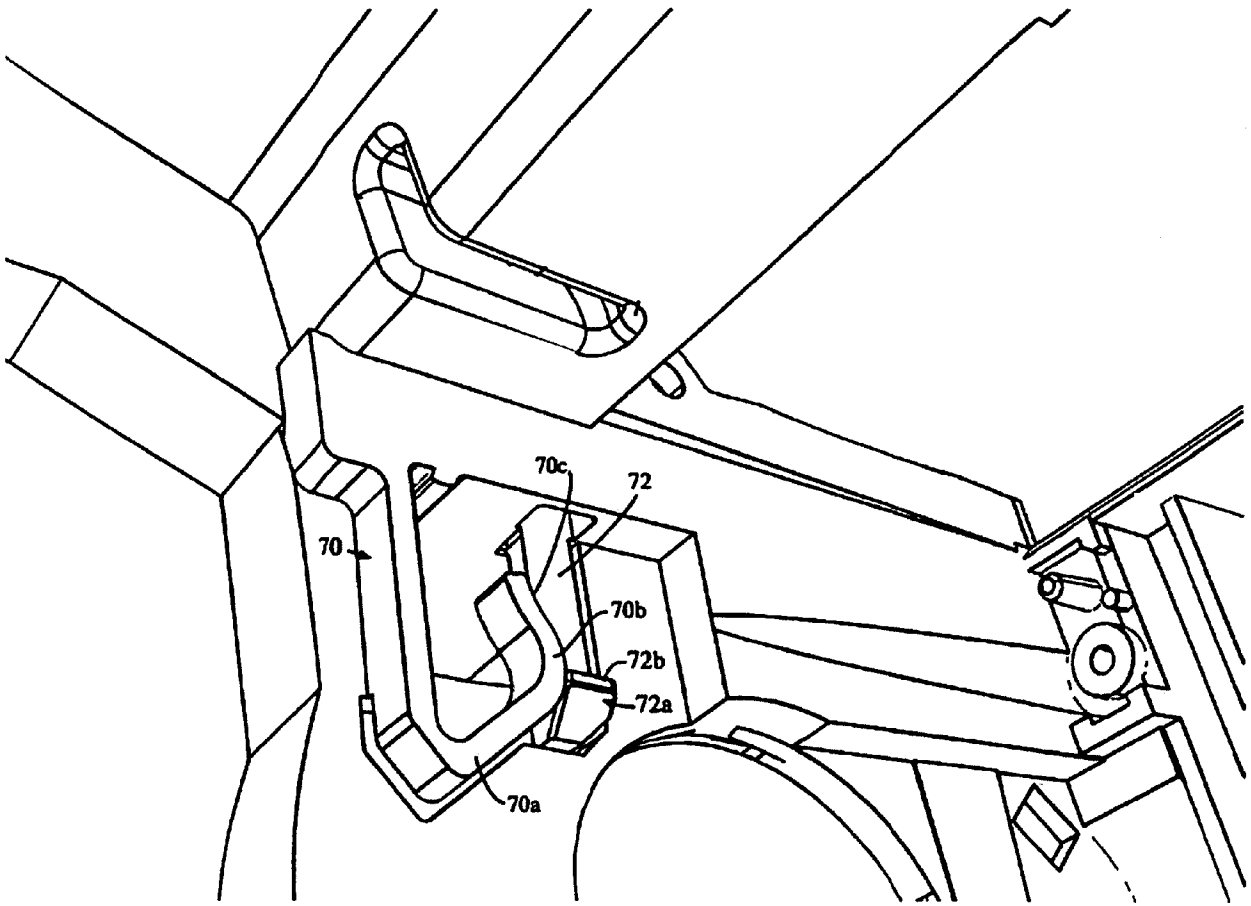
FIG. 5A is a first perspective inside view of the drive side of the waste bin of the novel toner cartridge.
Figure 5B:
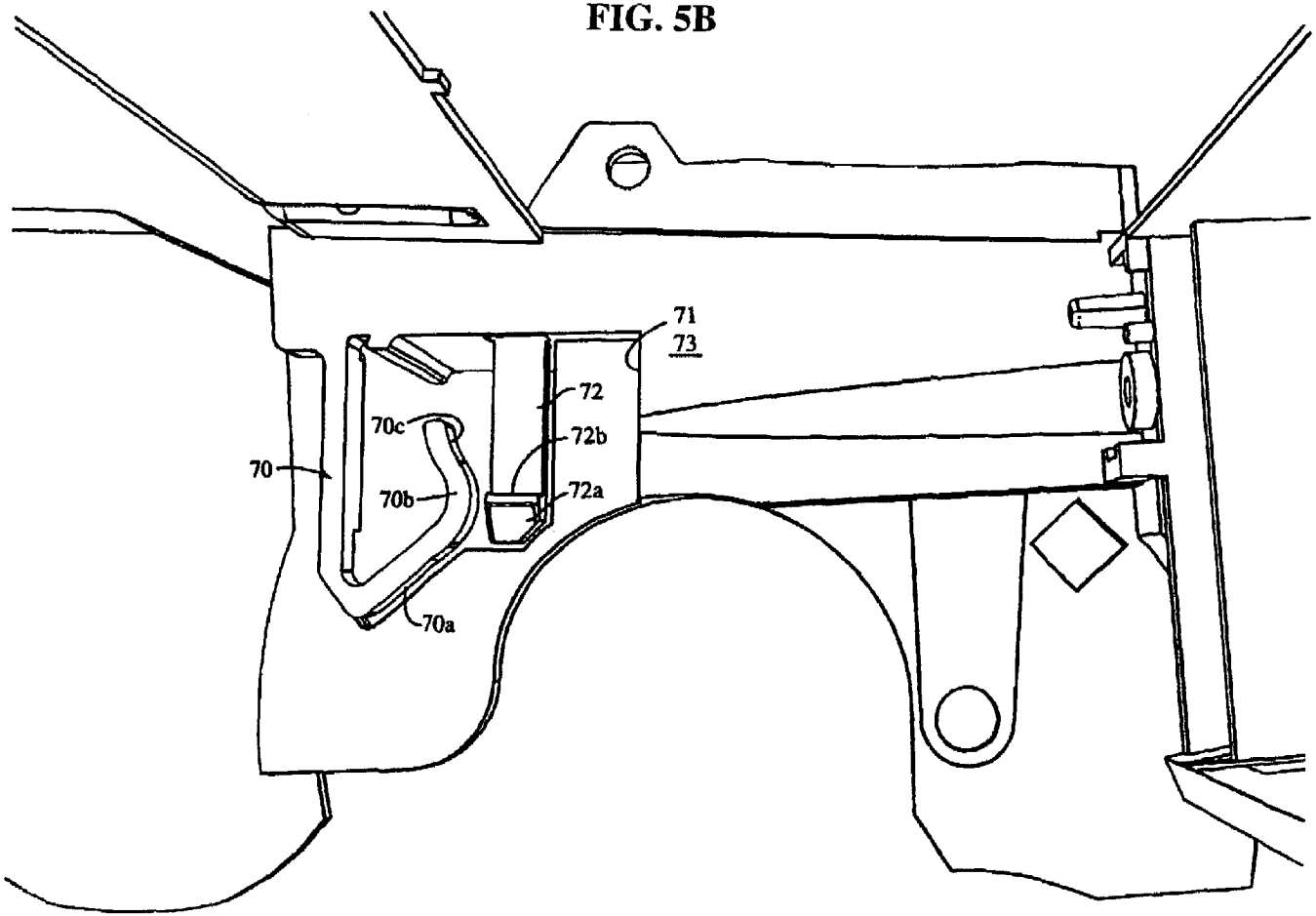
FIG. 5B is a second perspective inside view of the drive side of the waste bin of the novel toner cartridge.

When hopper pin 64 is causing horizontal retainer 70 to deflect away from its position of repose as aforesaid, said hopper pin simultaneously causes hopper pin vertical lock 72 to deflect away from its FIGS. 5A-B position of repose as well. When hopper pin 64 clears hook 72*a* at the free end of vertical lock 72, said vertical lock moves back toward its position of repose, thereby capturing the lower locating surface 64*c* of hopper pin 64. In this way, hopper pin 64 is captured on curved surface 64*a* by concavity 70*c*, on upper locating surface 64*b* by the bottom side of level planar wing 53, and on lower locating surface 64*c* by flat wall 72*b* of hook 72*a*.

The deflection of hopper pin 64 toward the front of the novel toner cartridge is limited by contact of the developer roller (not shown) in the hopper and the photoconductor drum, not shown, in the waste bin of the novel toner cartridge.

FIG. 5B illustrates hopper pin horizontal retainer 70 and hopper pin vertical lock 72 from a forward perspective relative to the rear perspective of FIG. 5A. It should be understood that both FIGS. 5A and 5B are taken from inside waste bin 2. FIG. 5B shows more clearly that said parts 70 and 72 are separate parts.

It is also best understood from FIG. 5B that neither part 70 or 72 is laterally supported by a wall; note opening 71 formed in sidewall 73 of waste bin 2. It is this lack of lateral support that requires the engagement of hopper torque tab 43 (FIG. 1C) and the inner side wall of waste bin 2.

Figure 6A:
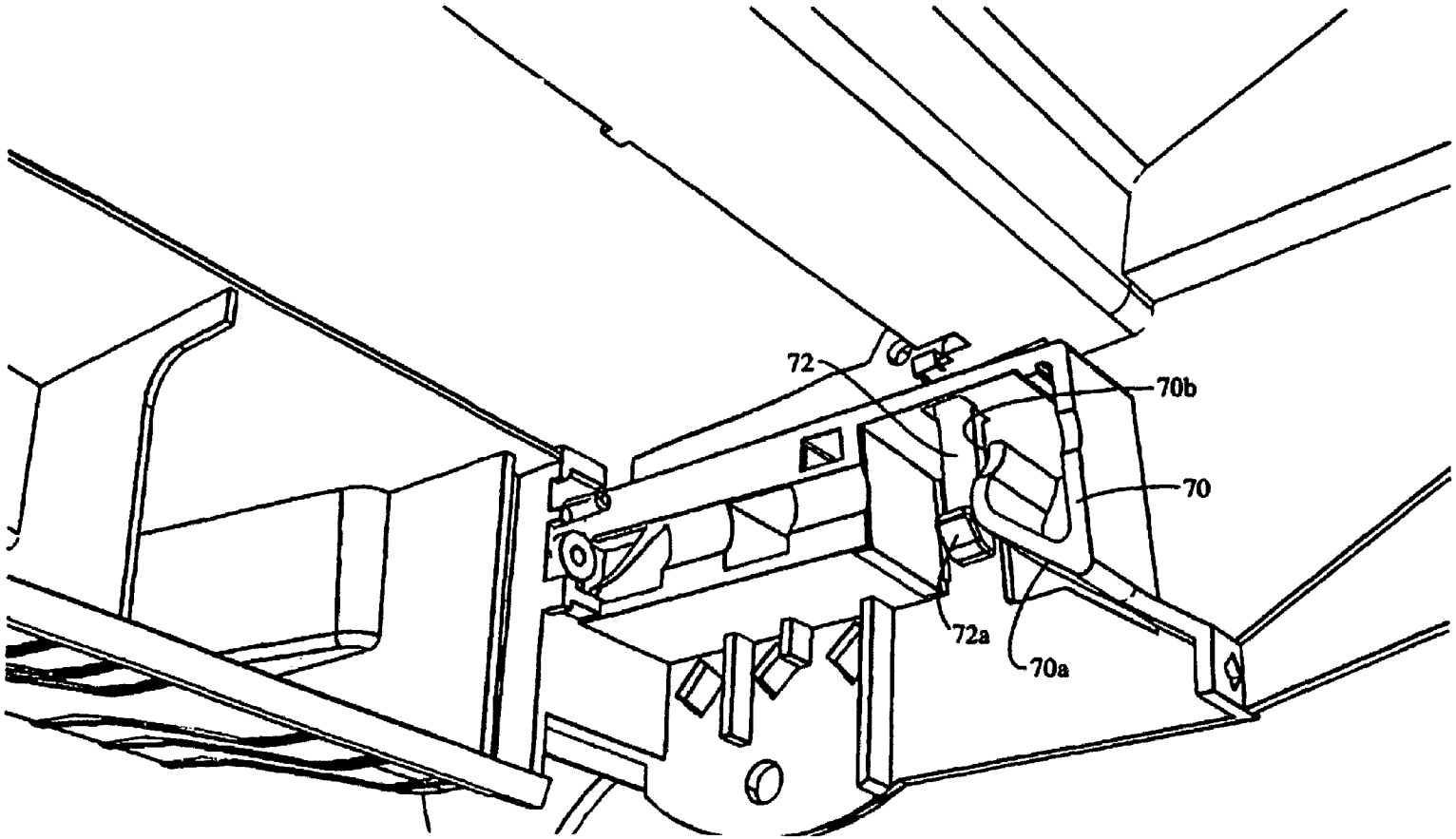
FIG. 6A is a first perspective inside view of the driven side of the waste bin of the novel toner cartridge.
Figure 6B:
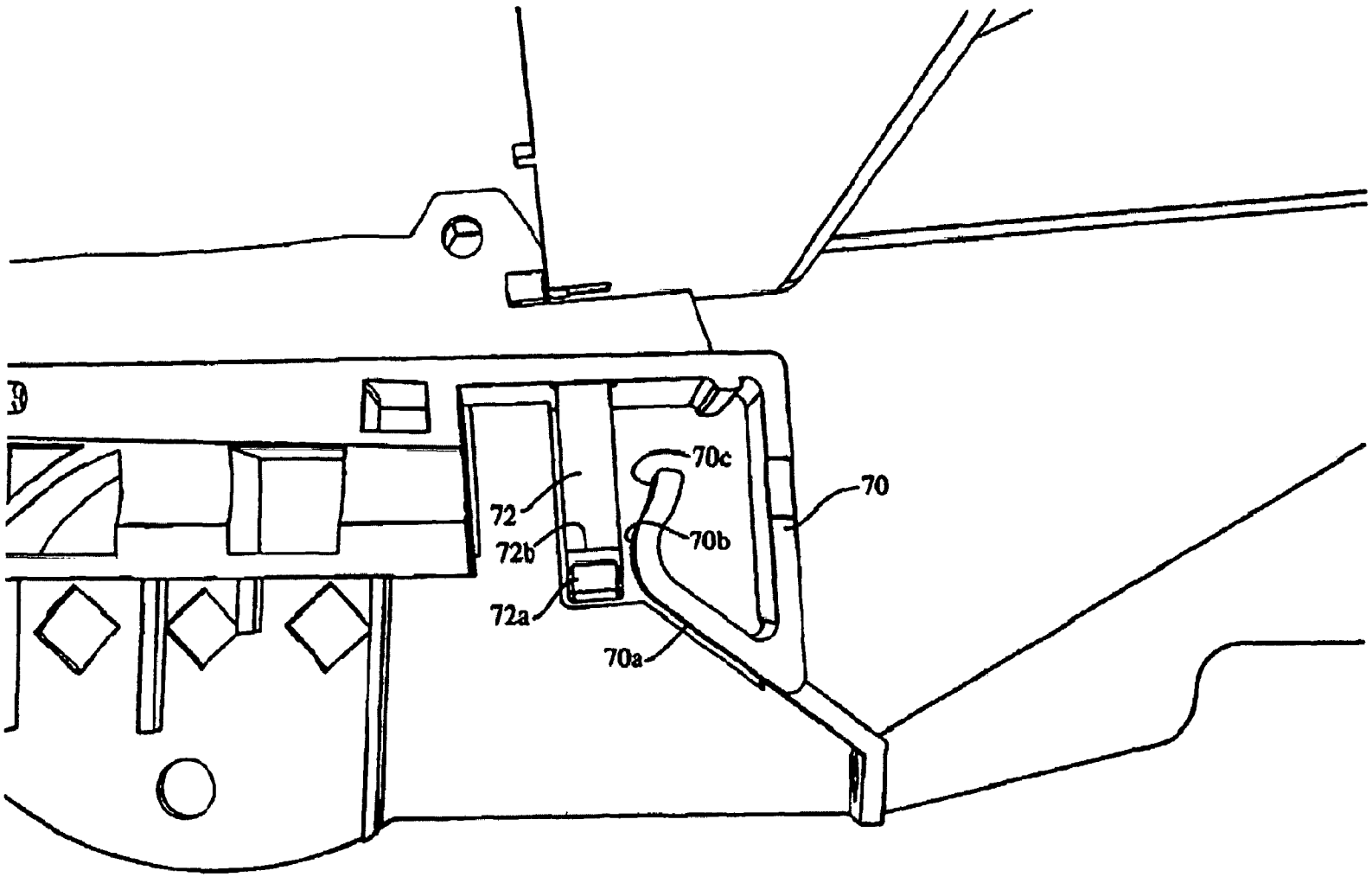
FIG. 6B is a second perspective inside view of the driven side of the waste bin of the novel toner cartridge.

FIGS. 6A and 6B depict hopper pin horizontal retainer 70 and hopper pin vertical lock 72 that are positioned on the driven side of waste bin 2. They perform the same function as their drive side counterparts and engage and capture the hopper pin associated with the non-drive side of waste bin 2.

Once hopper pin 64 is secured in horizontal retainer 70 and vertical lock 72 the trailing side walls of waste bin 2 are biased outward and the trailing end hopper 3 is raised until lower retaining shelves 59 engage receiving shelves 57. The trailing side walls of hopper 3 are then released whereby upper retaining surface 58 engages the upward facing surface of contoured surface 56 (FIG. 4B).

Figure 7A:
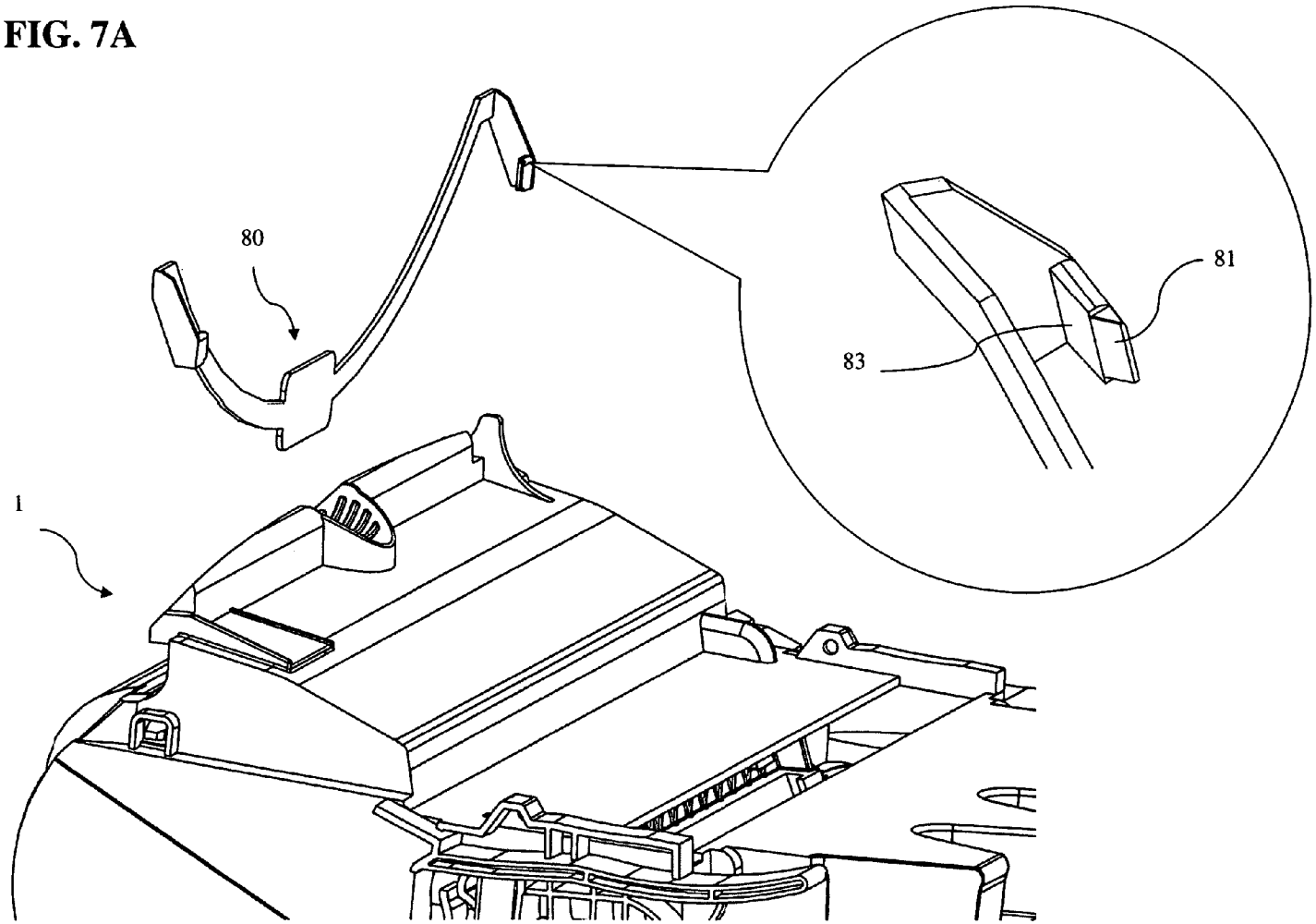
FIG. 7A is a perspective view of the developer roller preserver of the novel toner cartridge.
Figure 7B:
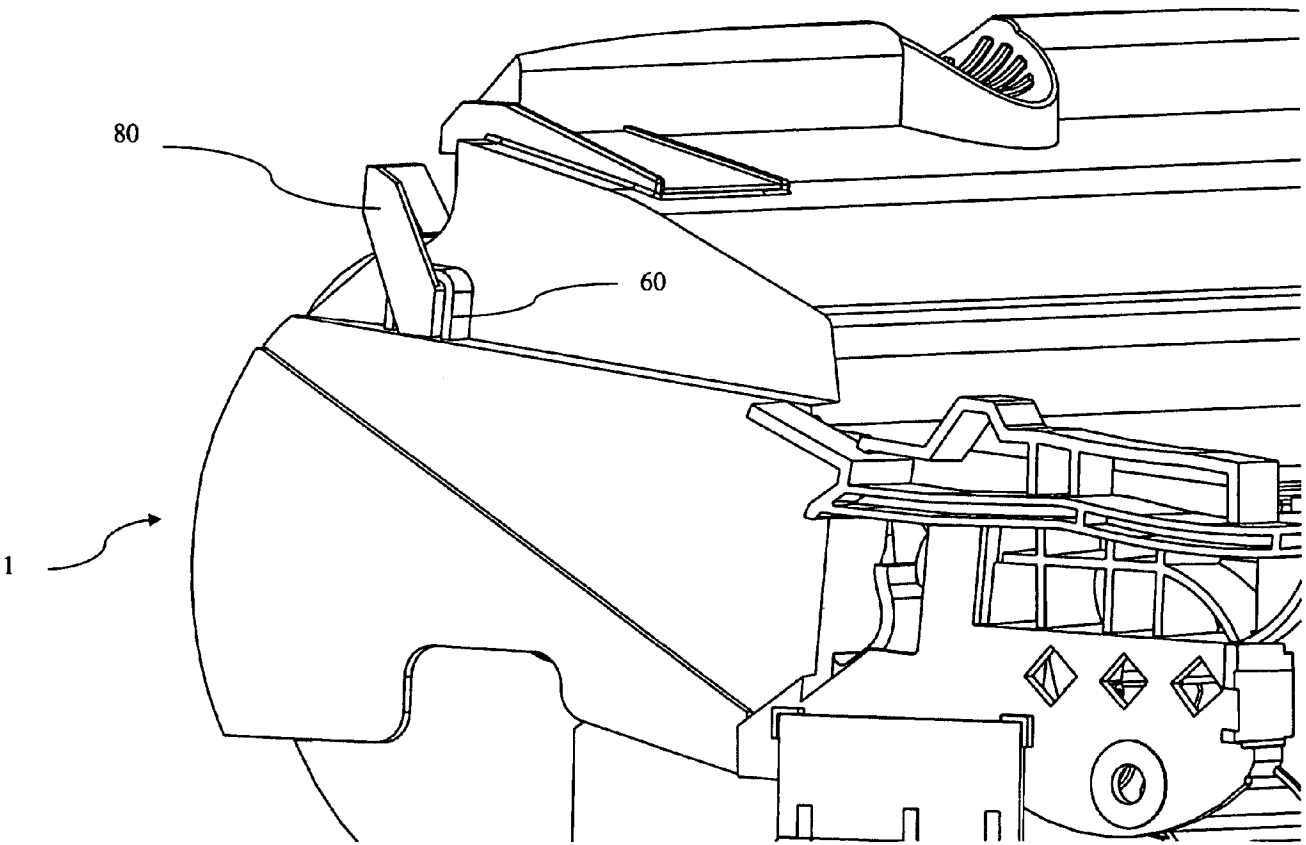
FIG. 7B is a perspective view of the developer roller preserver engaging the apertures of the waste bin of the novel toner cartridge.

During assembly, extension arm apertures 60 on the trailing end of waste bin 2 receive extension arms 62 (FIGS. 2 and 3) mounted to hopper 3. Developer roller preserver 80 (FIG. 7A) has wedged surfaces 81 at it is ends. Wedged surfaces 81 are inserted between the leading ends of extension arms 62 and extension arm apertures 60. Wedged surfaces 81 serve to push hopper 3 slightly rearward relative to waste bin 2. Once inserted, spacer surfaces 83 displace extension arms 62 and extension arm apertures 60. Once in place, as shown in FIG. 7B, a minute space forms between the developer roller and the photoconductive drum (not shown). The space between the developer roller and the photoconductive drum prevents the surface of the developer roller from developing a flat-spot where it abuts the photoconductive drum when the toner cartridge is being shipped or stored.

Electrical Contacts

Figure 8A:
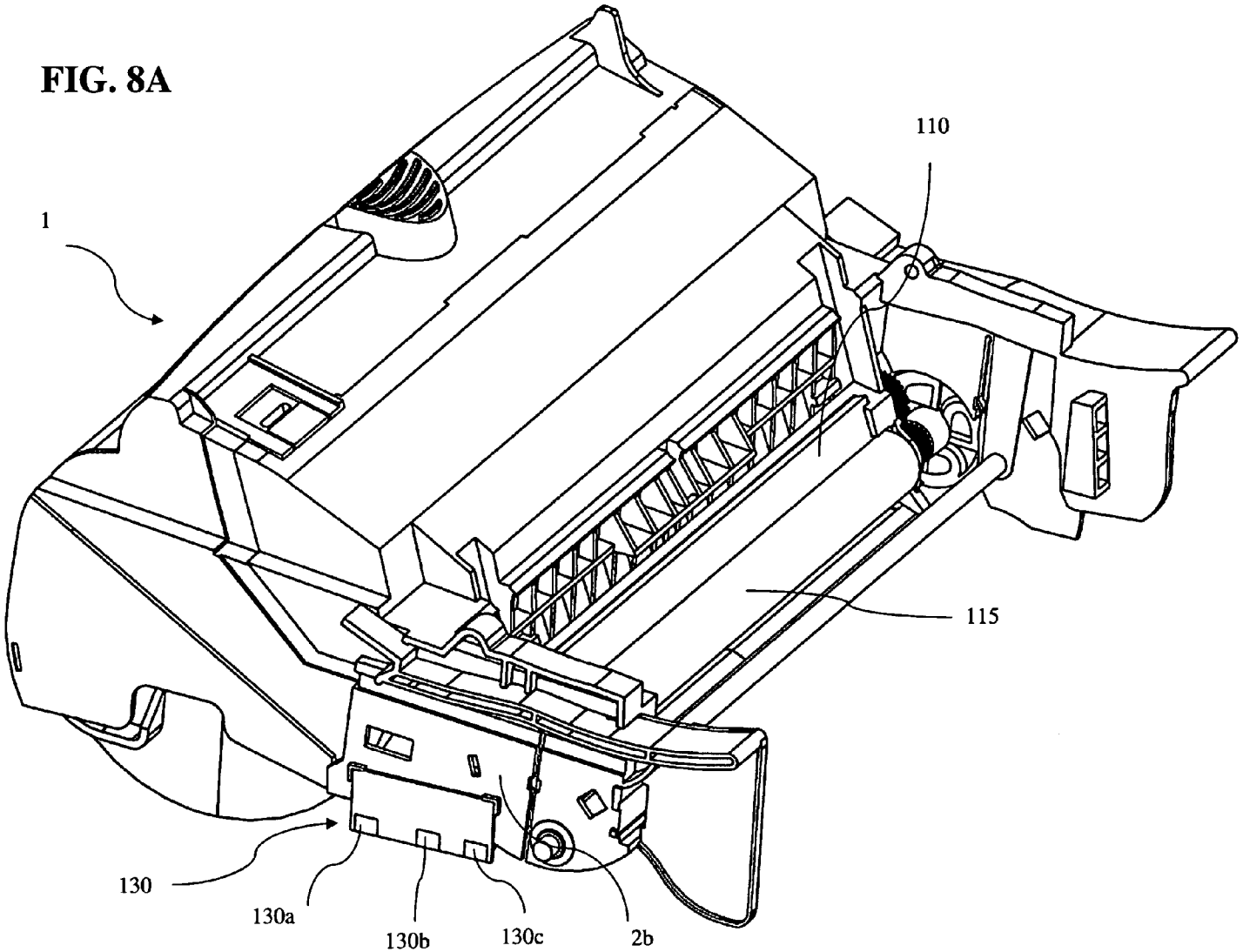
FIG. 8A is a top left perspective view of the novel toner cartridge with cover elements removed showing the relationship between developer roller, doctor bar, and electrical contact plate.
Figure 8B:
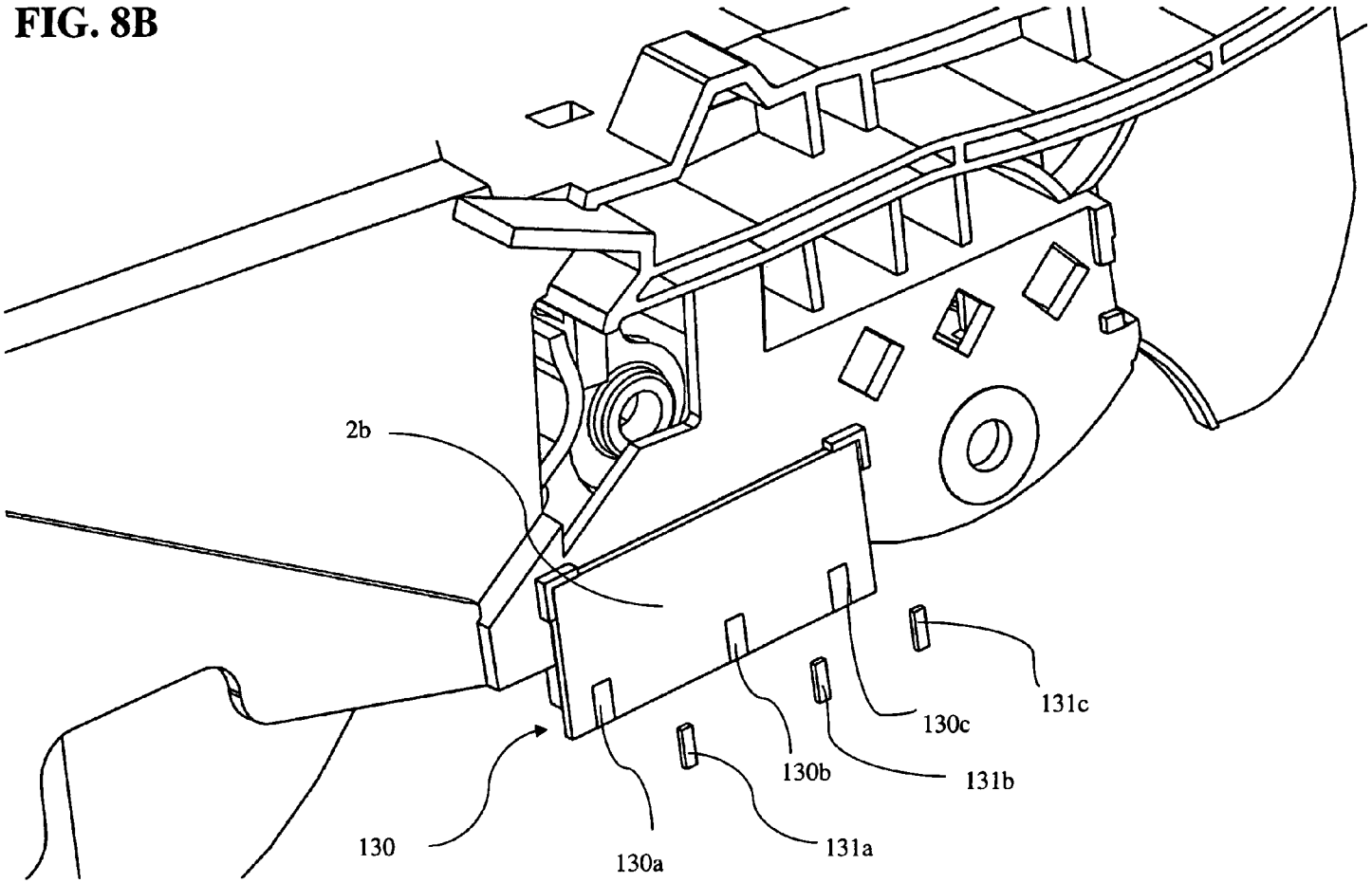
FIG. 8B is a perspective view of the electrical contact plate.

FIG. 8A is a top left view of the novel toner cartridge with cover elements removed to partially illustrate the internal configuration of novel toner cartridge 1. Solid steel doctor bar 110 extends parallel with and in pressure contact with developer roller 115. Doctor bar 110 contacts developer roller 115, at about 20 degrees from vertical away from adder roller for example (not shown in FIG. 8A). Electrical contact plate 130 is disposed on the outer side wall 2*b* of waste bin 2. Electrical contact points 130*a*, 130*b*, and 130*c* are disposed on the exposed face of contact plate 130 and provide an interface for electrical communication between the host printer and the doctor bar, toner adder roller and developer roller. Conductive bars 131*a*, 131*b*, and 131*c* can be added to electrical contacts 130*a-c*, FIG. 8B, to enhance conductivity with the printer contacts.

Figure 9A:
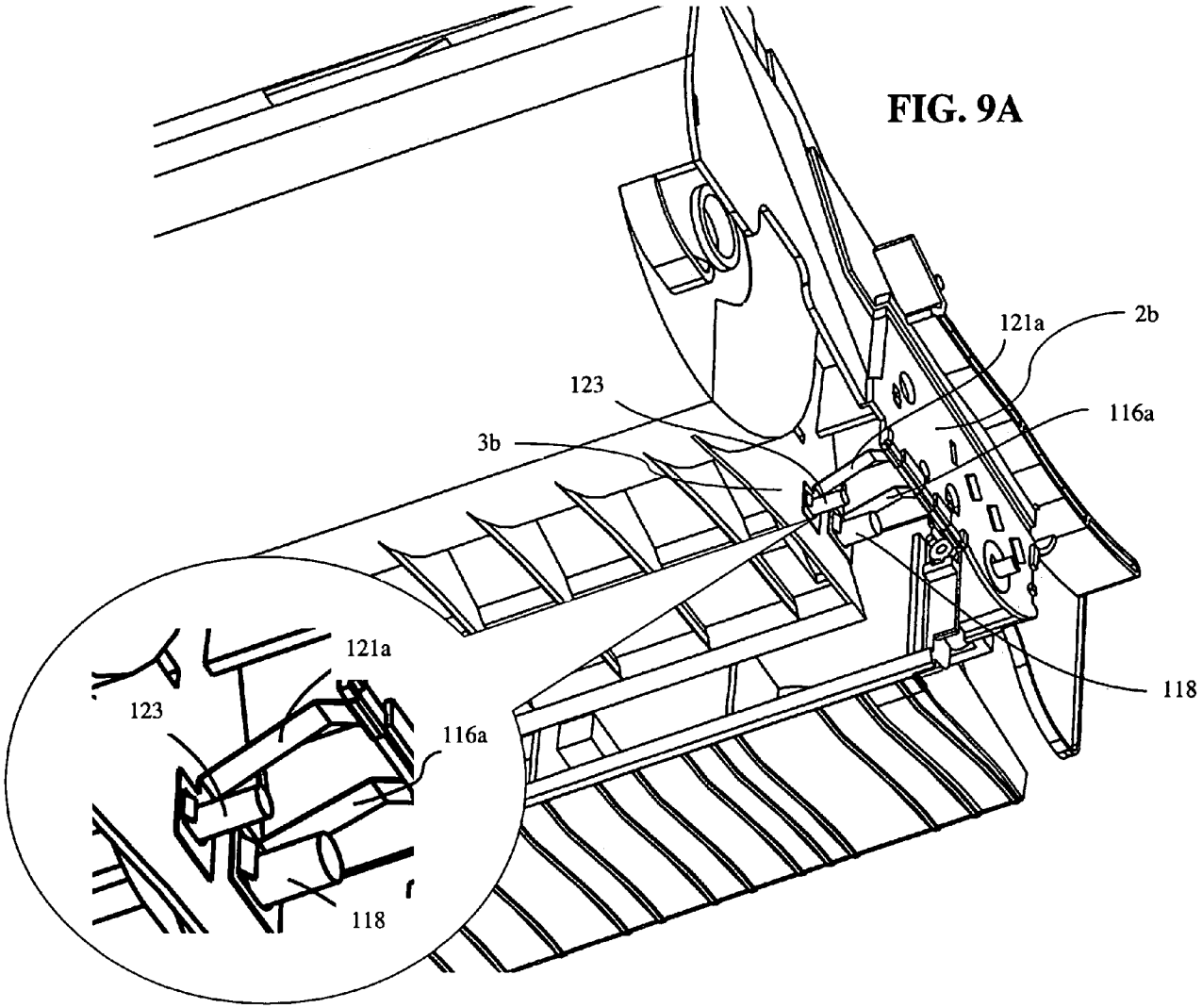
FIG. 9A is perspective view of the first embodiment of the electrical connections of the novel toner cartridge.
Figure 9B:
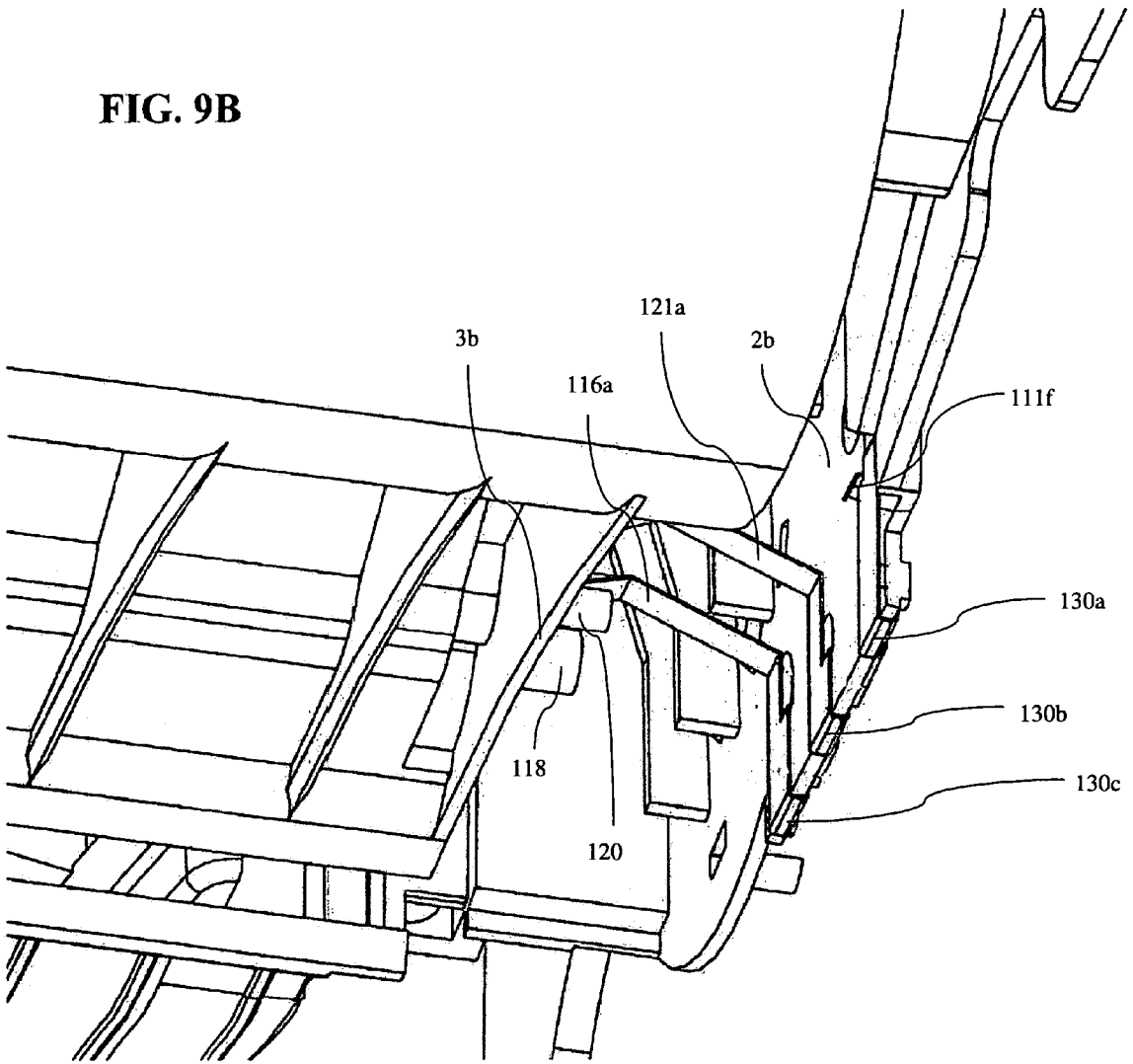
FIG. 9B is an alternative perspective view of the first embodiment of the electrical connections of the novel toner cartridge.

A first embodiment, shown in FIGS. 9A and 9B, contact bar 121*a*, in the form of a filament having a receptacle adapted to receive and make electrical contact with adder roller shaft 123. Contact bar 121*a* then extends across the gap between outer side wall 3*b* of hopper 3 and contact point 130*b* on outer side wall 2*b* of waste bin 2 as shown in FIGS. 9A and 9B. In this manner, good conductivity is made between contact bar 121*a* and adder roller shaft 123. Contact bar 121*a* then bridges the gap between side wall 3*b* of hopper 3 and outer side wall 2*b* of waste bin 2.

Contact bar 116*a* in the form a filament having a receptacle is adapted to receive and make electrical contact with developer roller shaft 118. In this manner, good conductivity is made between contact bar 116*a* and developer roller shaft 118. Contact bar 116*a* then bridges the gap between side wall 3*b* of hopper 3 and outer side wall 2*b* of waste bin 2.

Although not shown in FIGS. 9A and 9B, FIGS. 10B and 11B show how contact blade 111 makes electrical contact with doctor bar 110 and is held in place by receiving slot 113 integral to hopper 3 Contact blade 111 is attached to connecting wire 111*a* that bridges the gap between side wall 3*b* of hopper 3 and outer side wall 2*b* of waste bin 2. Rearmost electrical contact point 130*a* (FIG. 9B) has protrusion 111*f* to connect to connecting wire 111*a* that grounds doctor blade.

Once doctor bar 110, developer roller 115, and adder roller 120 have made electrical contact with contact points 130*a*, 130*b*, and 130*c*, attached to outer side wall 2*b*, novel toner cartridge 1 mates with contacts inside the printer.

Figure 10A:
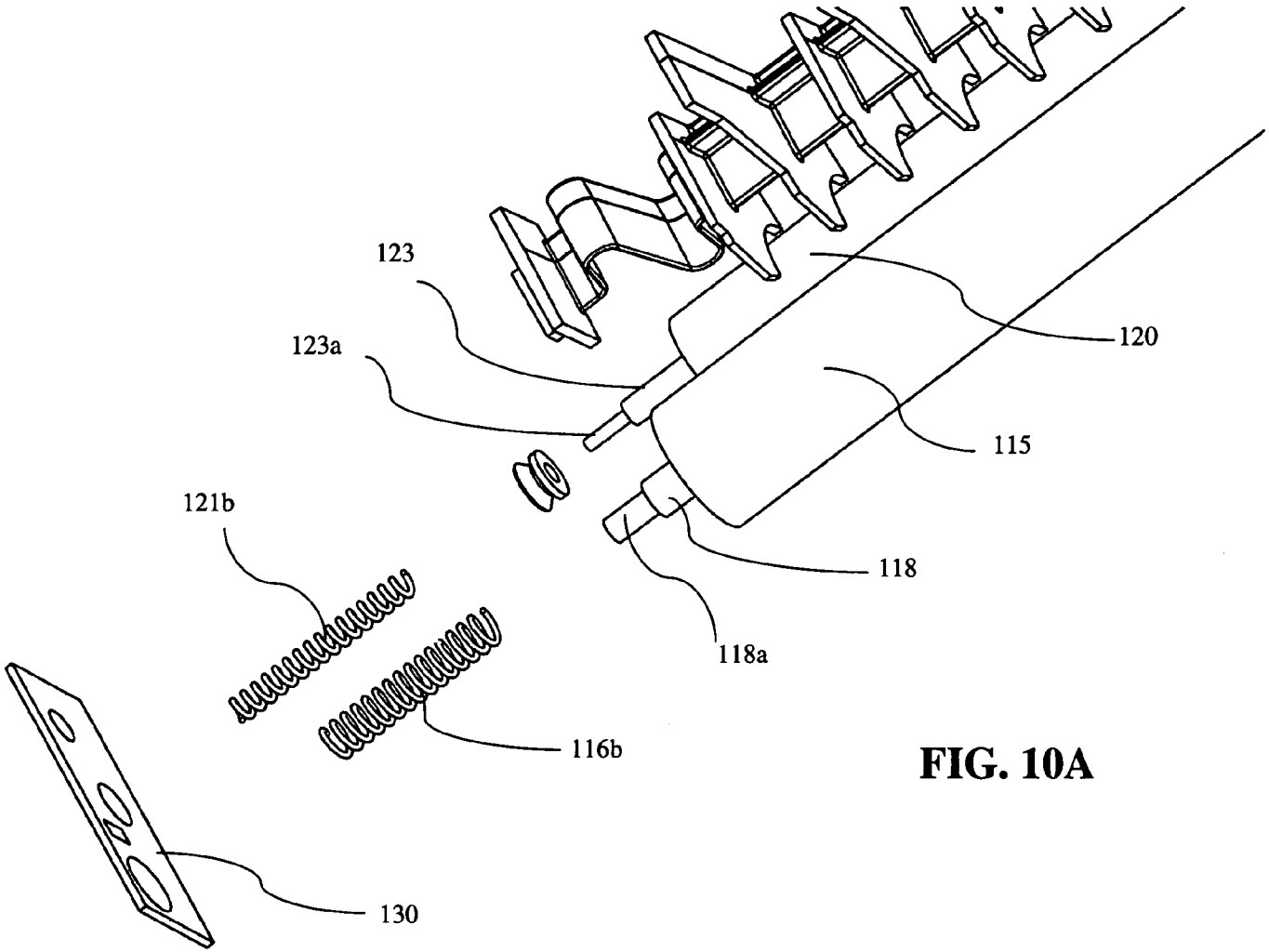
FIG. 10A is perspective view of the second embodiment of the electrical connections of the novel toner cartridge.
Figure 10B:
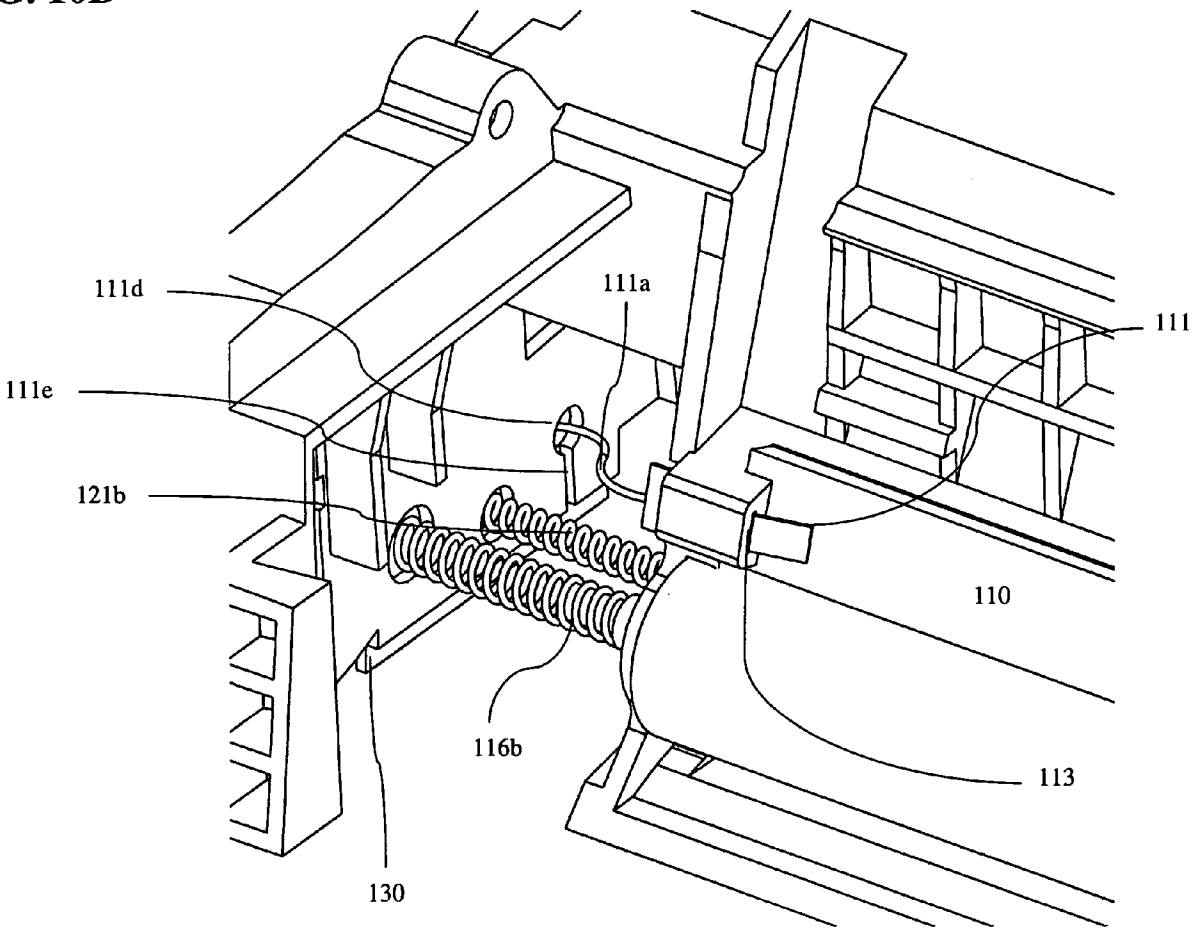
FIG. 10B is an alternate perspective view of the second embodiment of the electrical connections of the novel toner cartridge.
Figure 10C:
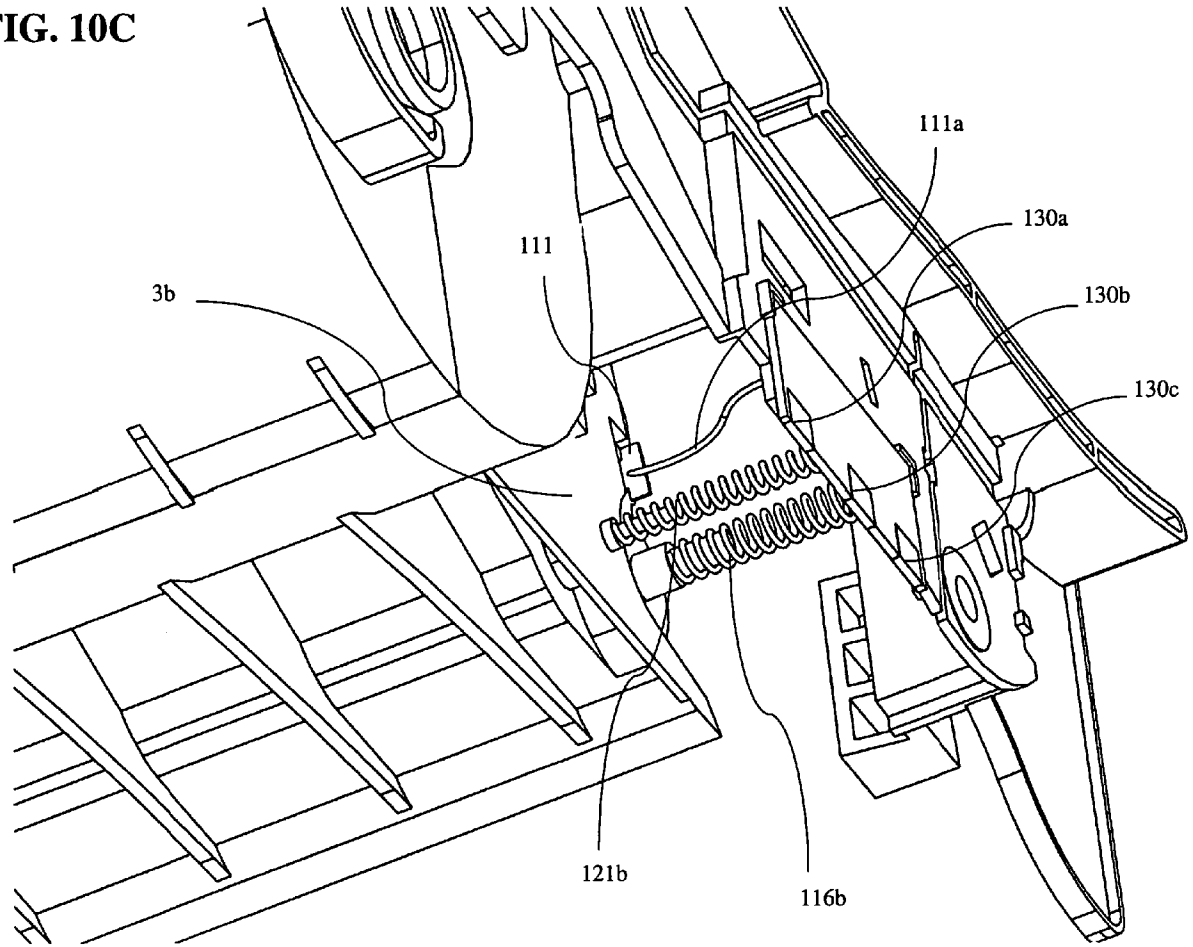
FIG. 10C is an alternate perspective view of the second embodiment of the electrical connections of the novel toner cartridge.

A second embodiment, shown in FIGS. 10A through 10C, contact spring 121*b* accepts step-down 123*a* on adder roller shaft 123. In this manner, good conductivity is made between contact spring 121*b* and adder roller shaft 123. Contact spring 121*b* then bridges the gap between side wall 3*b* of hopper 3 and contact plate 130 on outer side wall 2*b* of waste bin 2 (FIGS. 10B and 10C).

Contact spring 116*b* accepts step-down 118*a* on developer roller shaft 118. In this manner, good conductivity is made between contact spring 116*b* and developer roller shaft 118. Contact spring 116*b* then bridges the gap between side wall 3*b* of hopper 3 and contact plate 130 on outer side wall 2*b* of waste bin 2 (FIGS. 10B and 10C).

Figure 11A:
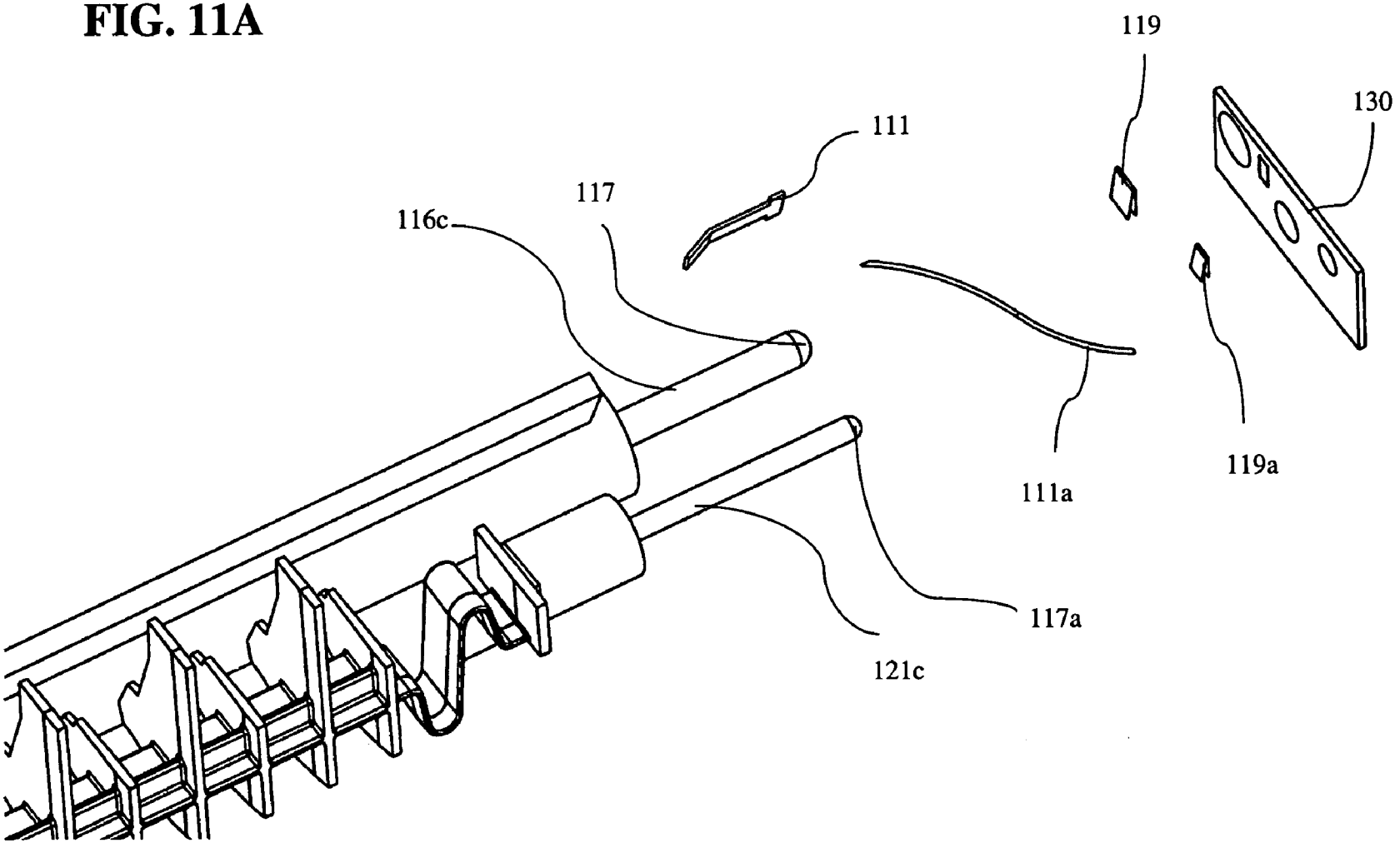
FIG. 11A is perspective view of a third embodiment of the electrical connections of the novel toner cartridge.
Figure 11B:
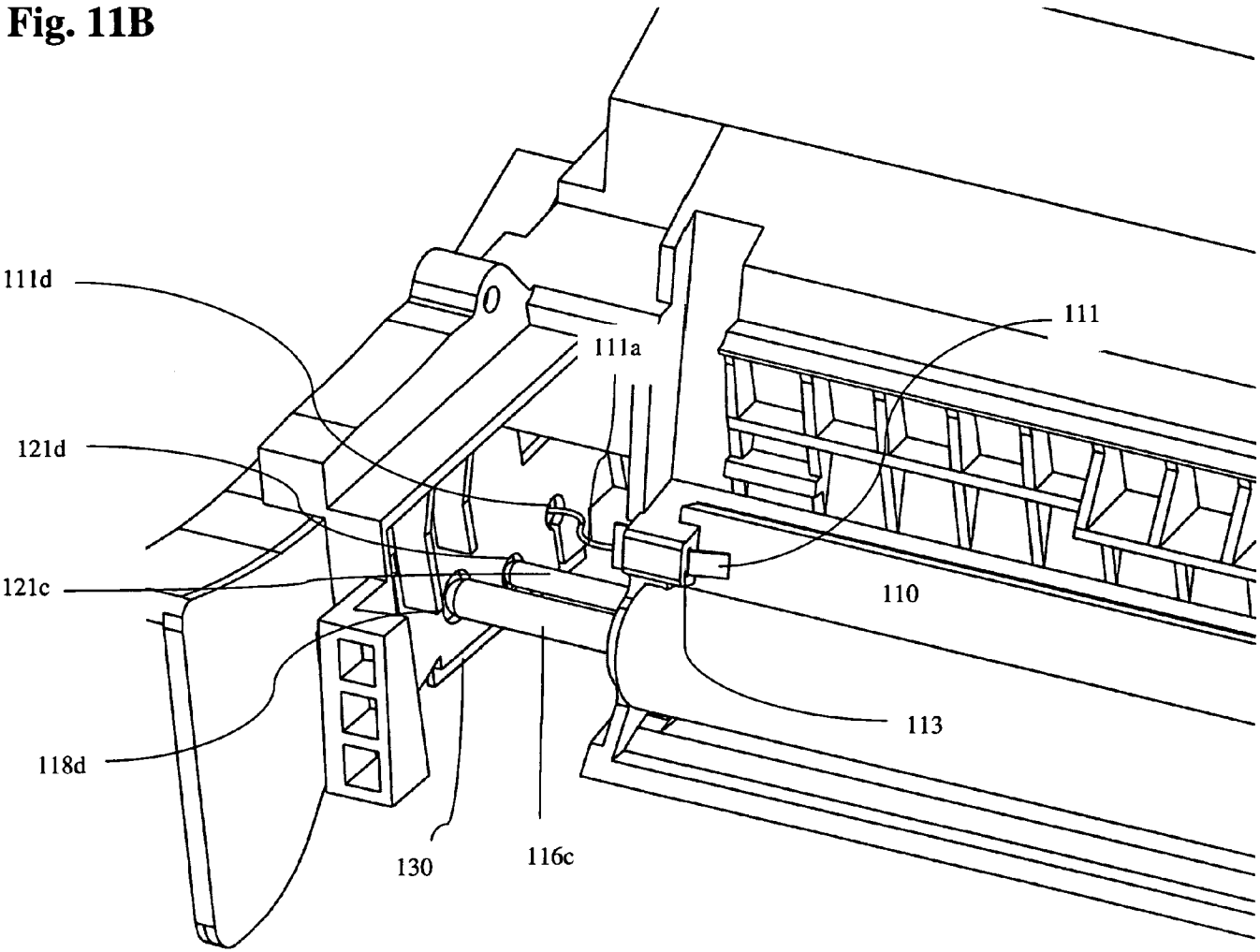
FIG. 11B is an alternate perspective view of a third embodiment of the electrical connections of the novel toner cartridge.

In all embodiments, illustrated in FIGS. 10B and 11B, contact blade 111 makes electrical contact with doctor bar 110 and is held in place by receiving slot 113 integral to hopper 3. Contact blade 111 is attached to connecting wire 111*a* that bridges the gap between side wall 3*b* of hopper 3 and contact plate 130 on outer side wall 2*b* of waste bin 2. Connecting wire 111*a* passes through aperture 111*d* disposed within outer side wall 2*b* in order to reach the back of contact plate 130 thus completing the connection. Slot 111*e* in outer side wall 2*b* allows for the installation of the assembly of connecting wire 111*a*.

Once doctor bar 110, developer roller 115, and adder roller 120 have made electrical contact with cartridge/printer contact plate 130, attached to outer side wall 2*b* novel toner cartridge 1 mates with contacts inside the printer.

Figure 11C:
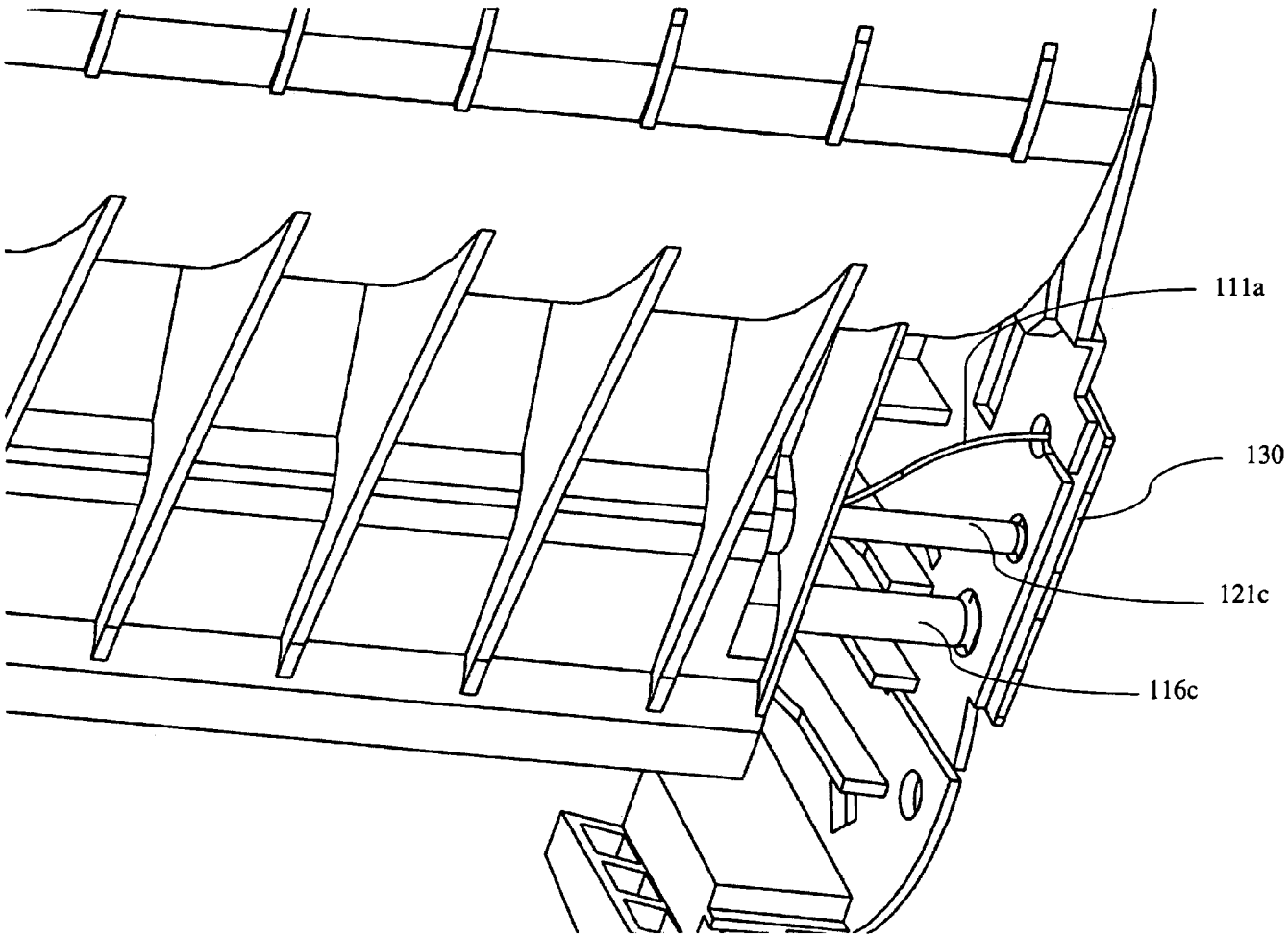
FIG. 11C is an alternate perspective view of a third embodiment of the electrical connections of the novel toner cartridge.

Turning now to FIGS. 11A through 11C, a third embodiment is shown wherein adder roller 120 has elongated shaft 121*c* that bridges the gap between side wall 3*b* of hopper 3 and contact plate 130 on outer side wall 2*b* of waste bin 2 by passing through hole 121*d*. Rounded tip 117*a* engages with conductive spring 119*a*, generally a folded conductive element but any conductive biasing means is contemplated. Folded spring 119*a* communicates with contact plate 130.

Developer roller 115 is adapted with elongated shaft 116*c* that bridges the gap between side wall 3*b* of hopper 3 and contact plate 130 on outer side wall 2*b* of waste bin 2 by passing through hole 118*d*. Rounded tip 117 engages with conductive spring 119, generally a folded conductive element but any conductive biasing means is contemplated. Folded spring 119 communicates with contact plate 130.

As with the previous embodiments, illustrated in FIGS. 10B and 11B, contact blade 111 makes electrical contact with doctor bar 110 and is held in place by receiving slot 113 integral to waste bin 2. Contact blade 111 is attached to connecting wire 111*a* that bridges the gap between side wall 3*b* of hopper 3 and contact plate 130 on outer side wall 2*b* of waste bin 2. Connecting wire 111*a* passes through aperture 111*d* disposed within outer side wall 2*b* in order to reach the back of contact plate 130 thus completing the connection. Slot 111*e* in outer side wall 2*b* allows for the installation of the assembly of connecting wire 111*a*.

Once doctor bar 110, developer roller 115, and adder roller 120 have made electrical contact with cartridge/printer contact plate 130, attached to outer side wall 2*b*, novel toner cartridge 1 mates with contacts inside the printer.

Sifting Agitator

Figure 12:
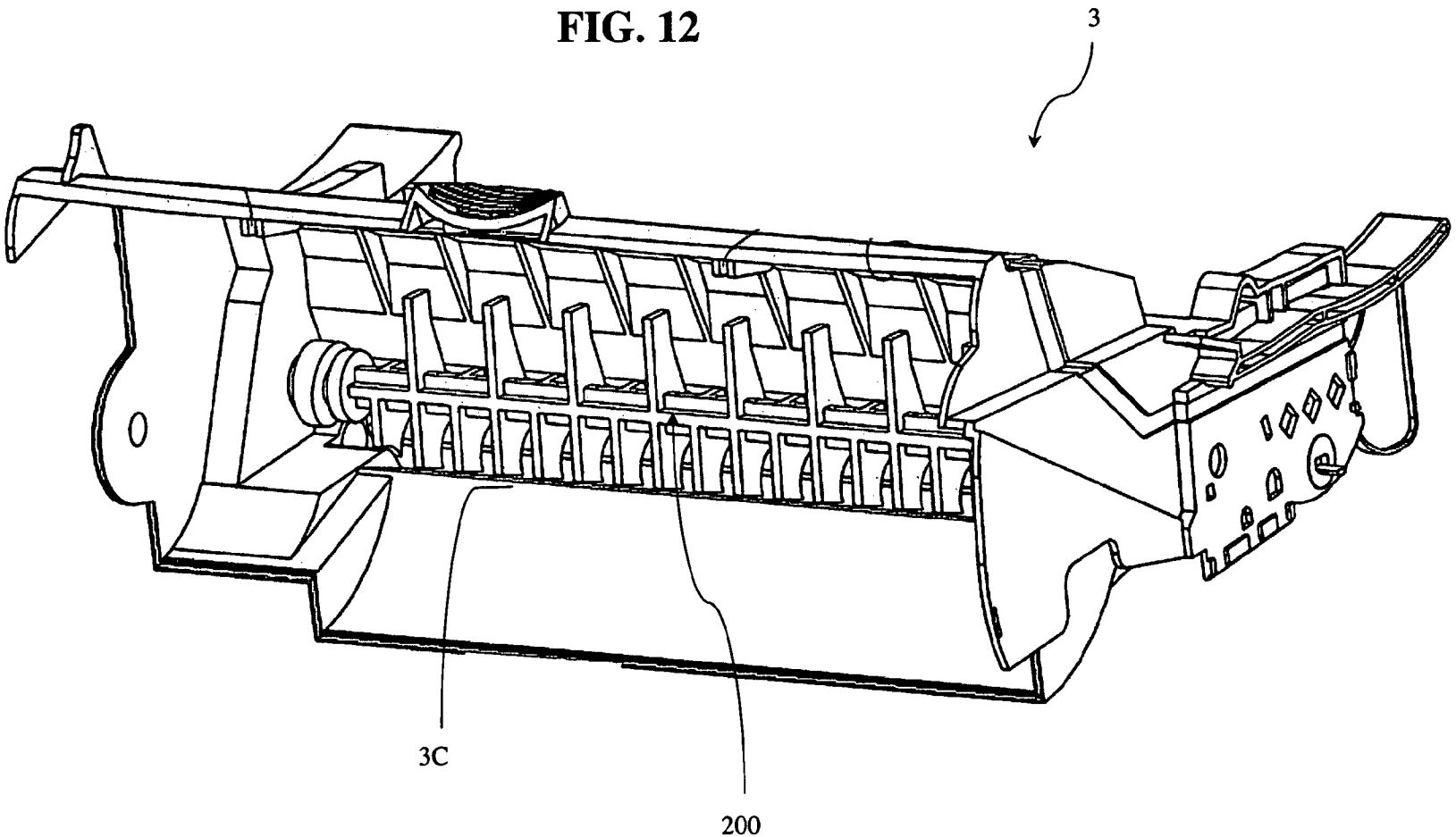
FIG. 12 is a rear perspective view of the novel toner cartridge showing the sifting agitator.
Figure 13:
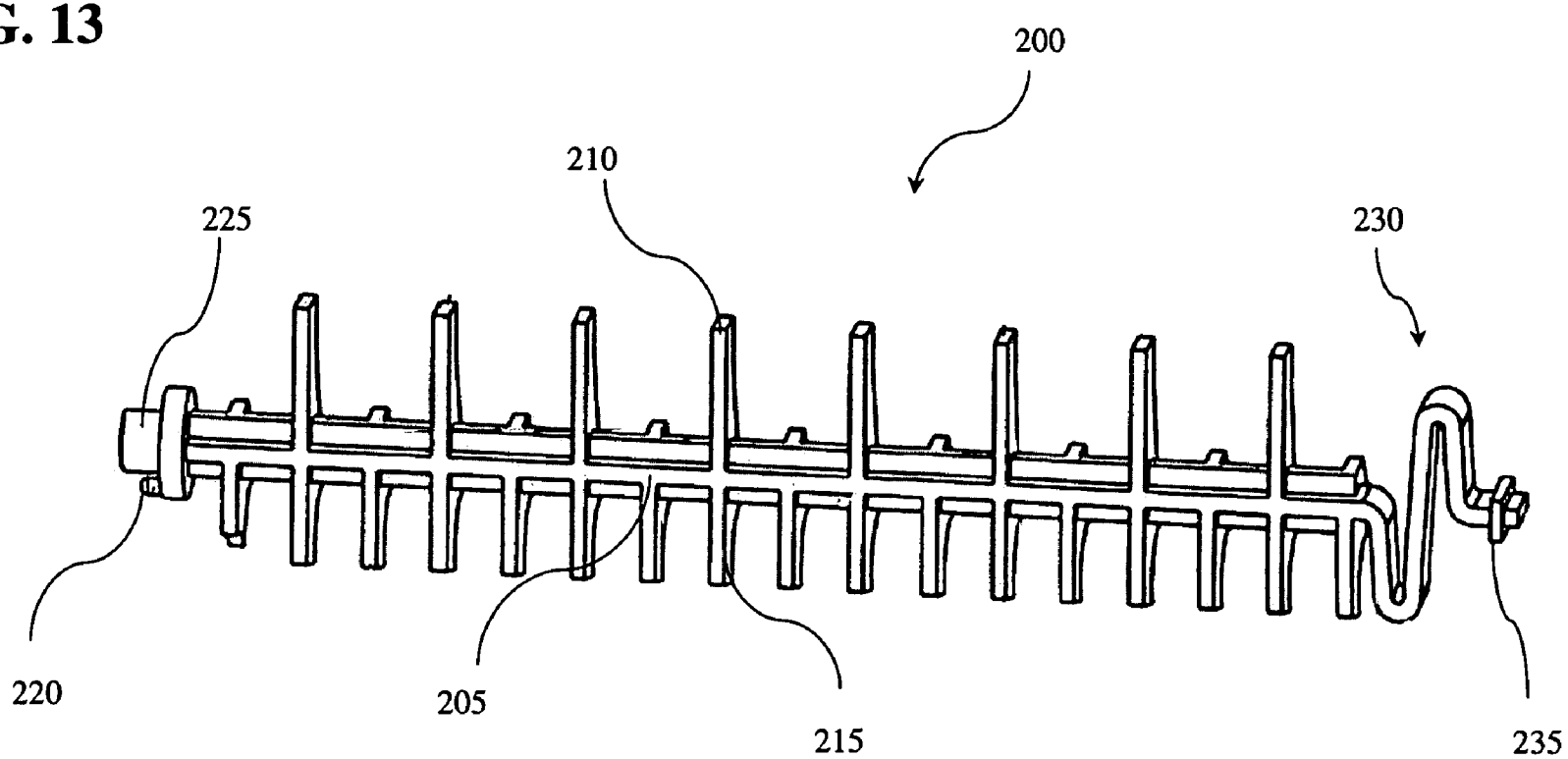
FIG. 13 is a perspective view of the first embodiment of the sifting agitator.
Figure 14A:
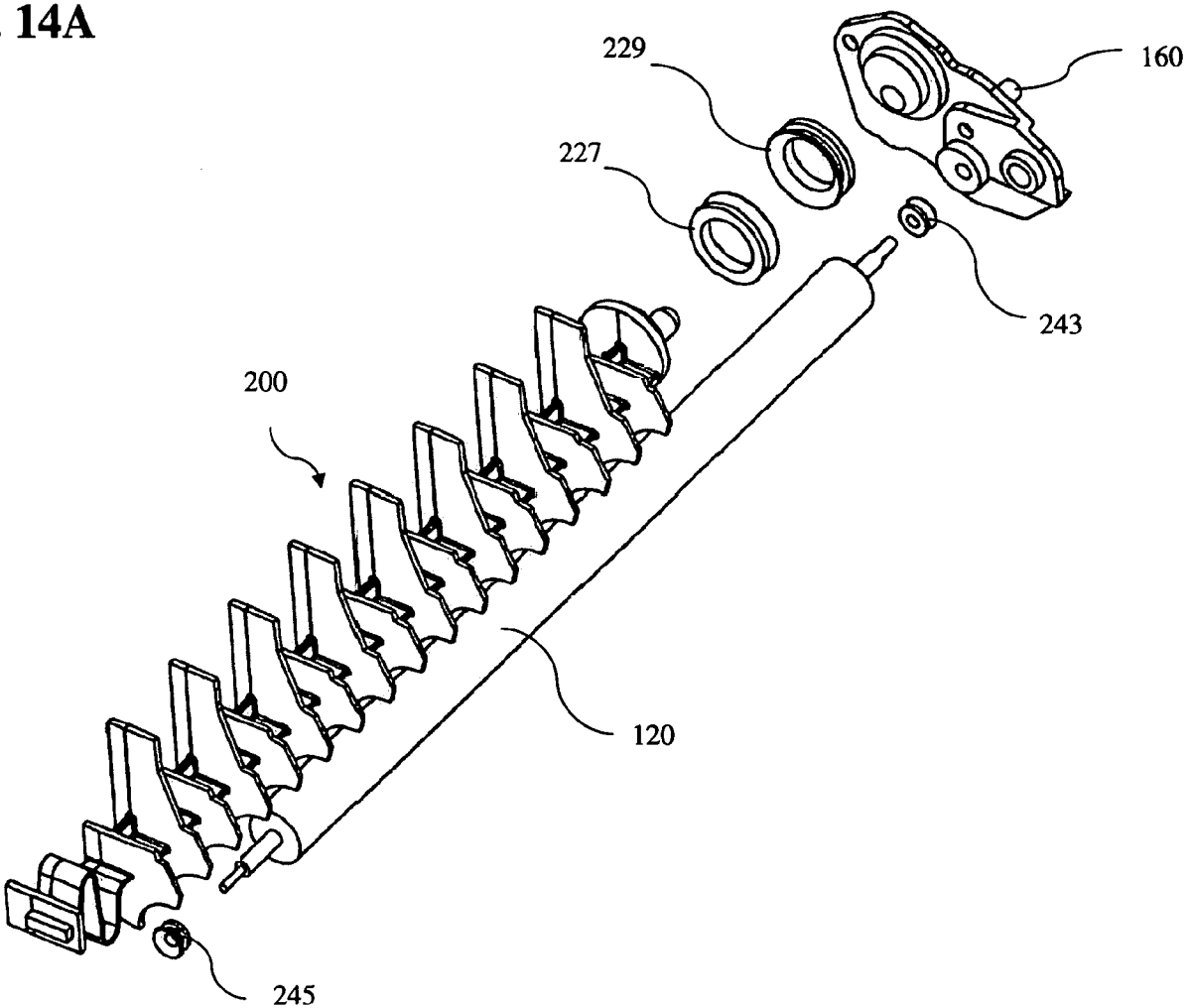
FIG. 14A is an exploded perspective view of the inter-relation of the sifting agitator, conforming seals, toner adder roller, and gear plate.
Figure 14B:
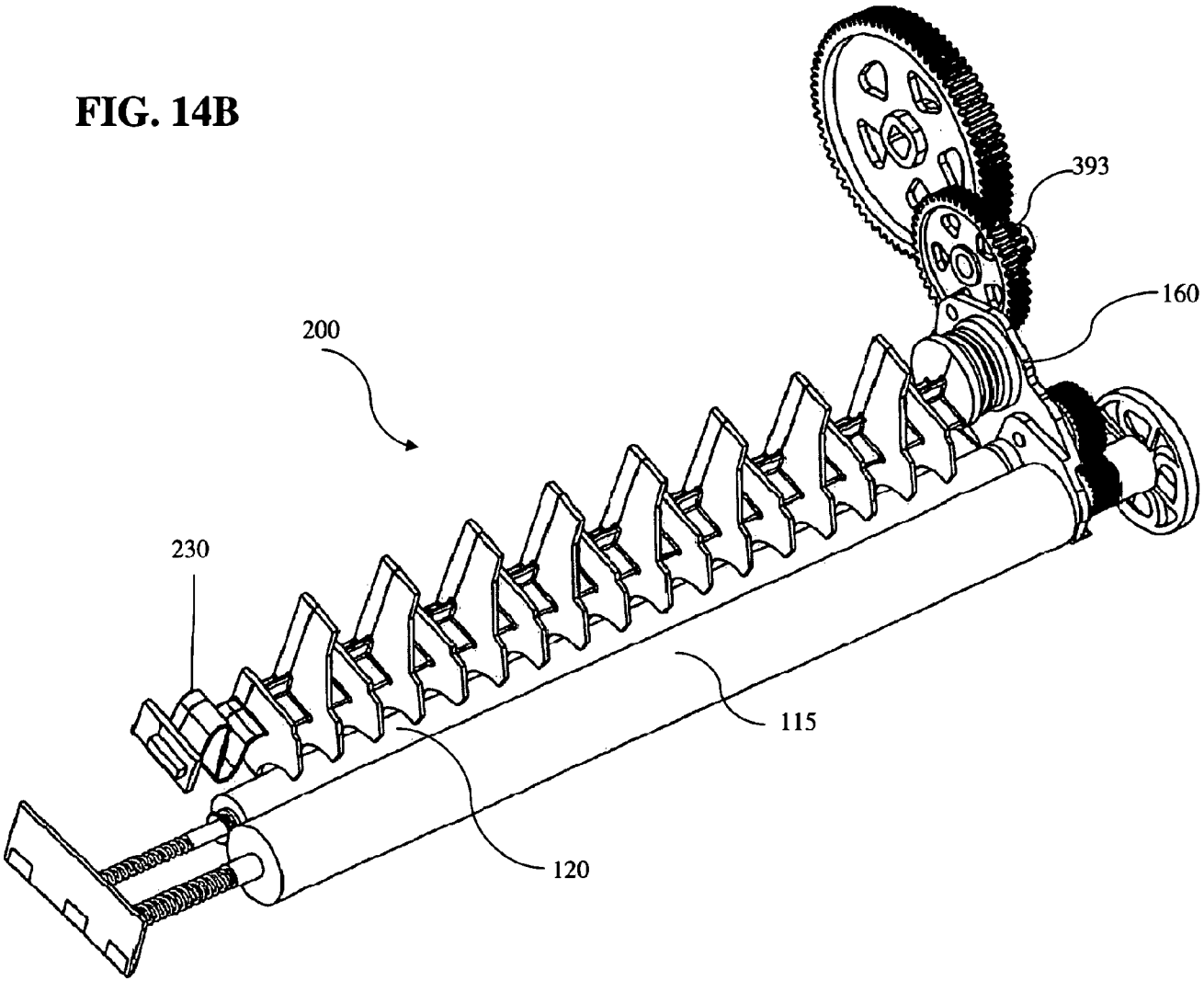
FIG. 14B is a perspective view of the inter-relation of the sifting agitator, conforming seals, toner adder roller, gear plate, developer roller, and gear train.
Figure 14C:
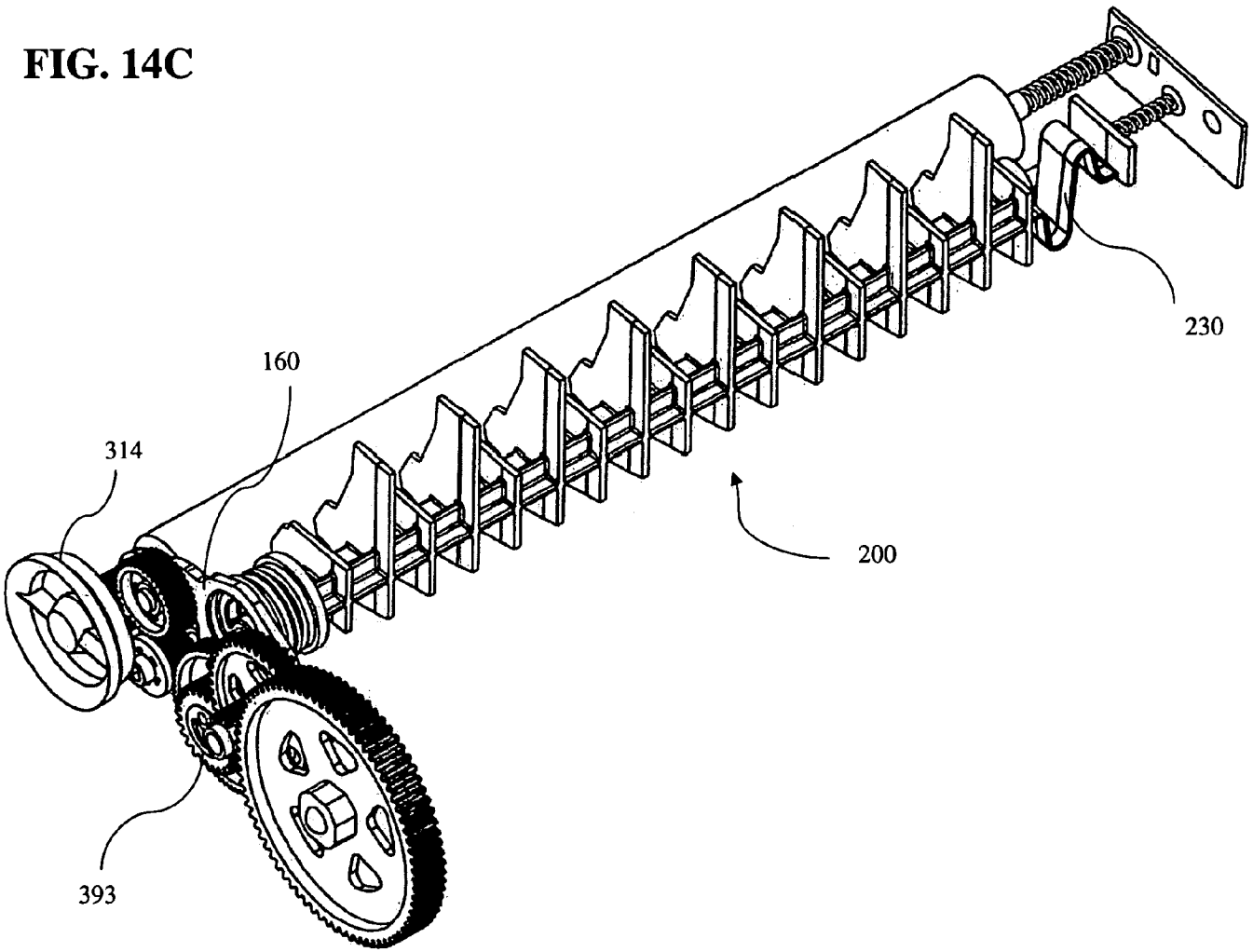
FIG. 14C is an alternate perspective view of the inter-relation of the sifting agitator, conforming seals, toner adder roller, gear plate, developer roller and gear train.

Sifting agitator 200 extends across flat surface 3*c* of hopper 3 (shown in cut away of FIG. 12). Turning now to FIG. 13, sifting agitator 200 comprises shaft 205, upper fins 210, lower chamber contouring fins 215, cam pin 220, axle 225, biasing spring 230, and pin 235. In a general embodiment, sifting agitator 200 oscillates across flat surface 3*c* during printer operations. Toner spreads evenly across the exit surface of the toner cartridge as lower chamber contouring fins 215 sift the exiting toner. FIGS. 14A through 14C show how lower chamber contouring fins 215 curve to fit toner adder roller 120 to ensure the closeness of sifting agitator 200 to toner adder roller 120. In so doing, toner disperses evenly across the exit surface immediately prior to contact with toner adder roller 120. The sifting agitator doesn't contact the adder roller but closely contours the lower surface of the toner chamber and the adder roller, thus assuring the toner stays sufficiently fluid and level near the adder roller.

Conforming seals 227 and 229 are disposed at the end of sifting agitator 200 to engage gear plate 160 and prevent the escape of toner from the sides of the cartridge. Similarly, conforming seals 243, 245 are placed on either end of toner adder roller 120.

FIG. 12 shows how toner sifter 200 oscillates across flat surface 3*c*. In FIG. 14C, drive dog gear 314 engages the drive apparatus of the printer (not shown). Rotation of drive dog gear 314 provides the rotational force for all gears in the gear train shown in FIG. 14C. Rotation of cam gear 393 applies lateral force on sifting agitator 200 by means of a beveled inner surface which engages and disengages pin 220 (FIG. 15).

Lateral movement of sifting agitator 200 away from the gear train causes biasing spring 230 to compress. When cam gear 393 disengages pin 220, biasing spring 230 expands returning sifting agitator to its home position. Spring biasing means 230 is integral to the sifting agitator and engages the interior of the toner chamber by means of pin 235. Thereby, after sifting agitator 200 is moved from its home position by cam gear 393, the potential energy stored in biasing spring 230 is exerted against sifting agitator 200 to return it to its home position. In addition to the biasing spring shown in FIGS. 14A through 14C, any resilient means for exerting the necessary force on sifting agitator 200 to return it to its home position are contemplated.

Figure 15:
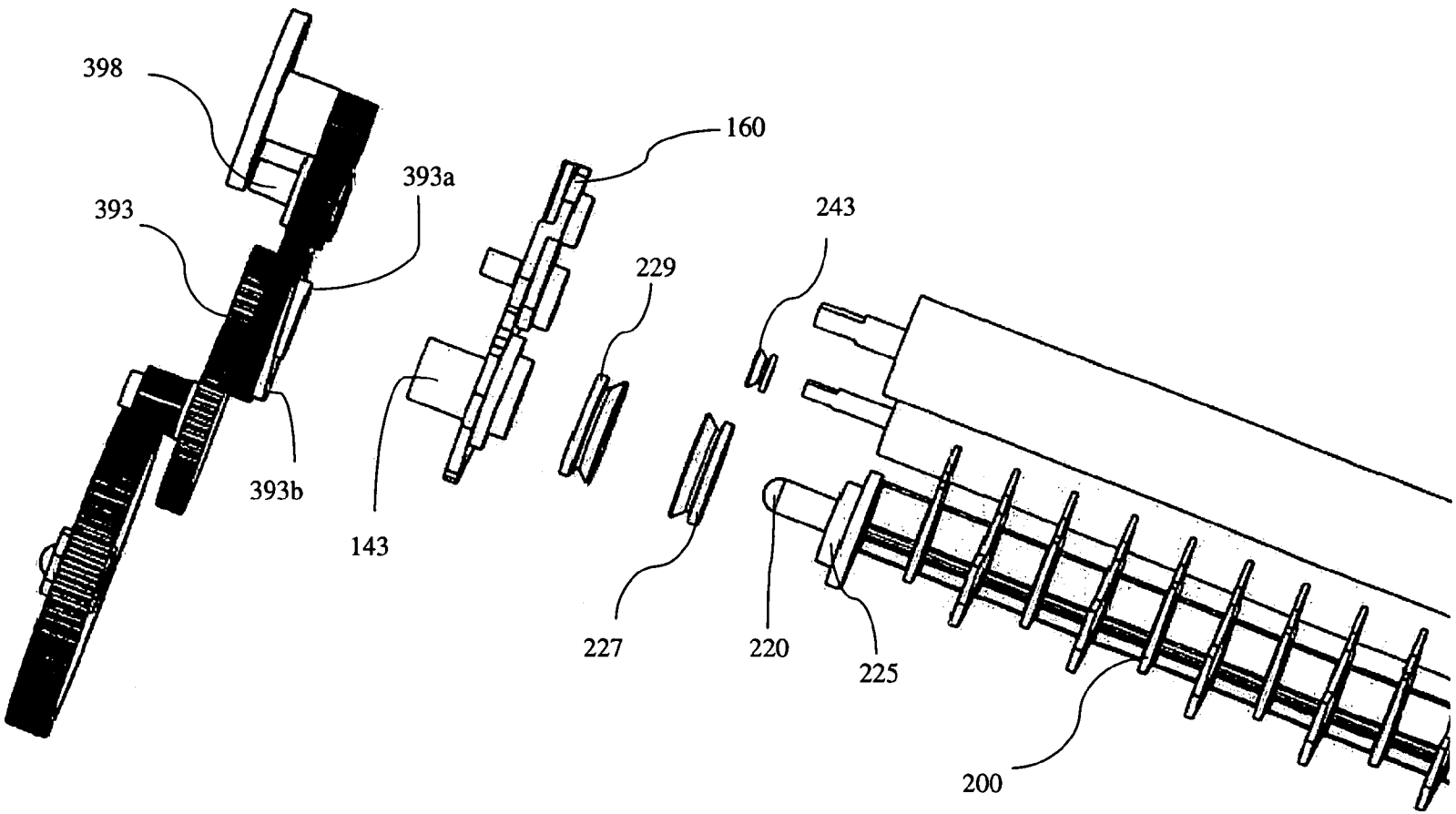
FIG. 15 is an exploded perspective view of the inter-relation of the sifting agitator, conforming seals, toner adder roller, gear plate, developer roller and gear train.
Figure 16:
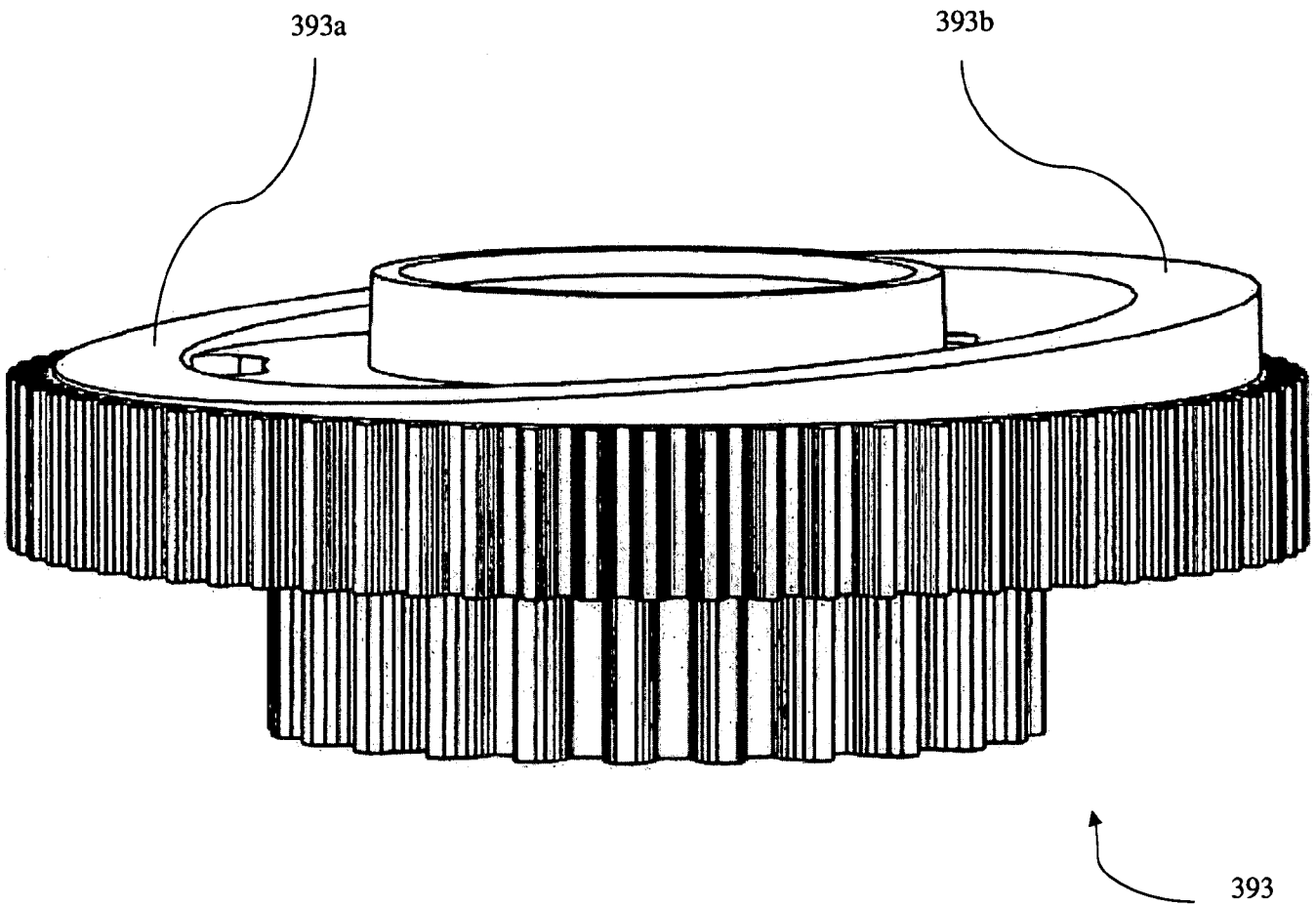
FIG. 16 is a side perspective view of the cam gear.

FIG. 15 shows an exploded view of the connection between sifting agitator 200 and cam gear 393 through gear plate 160. As it can be seen, shaft 205 of the sifting apparatus terminates in axle 225 which includes cam pin 220. Conforming seal 227 rests on the outer circumferential edge of axle 225 and mates with conforming seal 229. Conforming seal 229 correspondingly rests on a ridge of gear plate 160. When fully assembled, cam pin 220 extends through gear plate 160. The inner surface of cam gear 393 is beveled and has a high surface 393*b* and low surface 393*a*. Cam gear 393 rotates on cam axle 143 of gear plate 160. As cam gear 393 rotates, cam pin 220 is alternatively engaged by high surface 393*b* and disengaged by low surface 393*a*. When high surface 393*b* engages cam pin 220 sifting agitator 200 is urged laterally away from gear plate 160. When low surface 393*a* rotates to a position adjacent to cam pin 220 the potential energy stored in biasing spring 230 urges sifting agitator 200 to return to its home position. The continued rotation of cam gear 393, and the coincident revolution of high surface 393*b*, coupled with the resiliency of biasing spring 230 thereby create the oscillating movement of sifting agitator 200. Cam gear 393 is shown in greater detail in FIG. 16.

Cluster Gear Assembly

Figure 17:
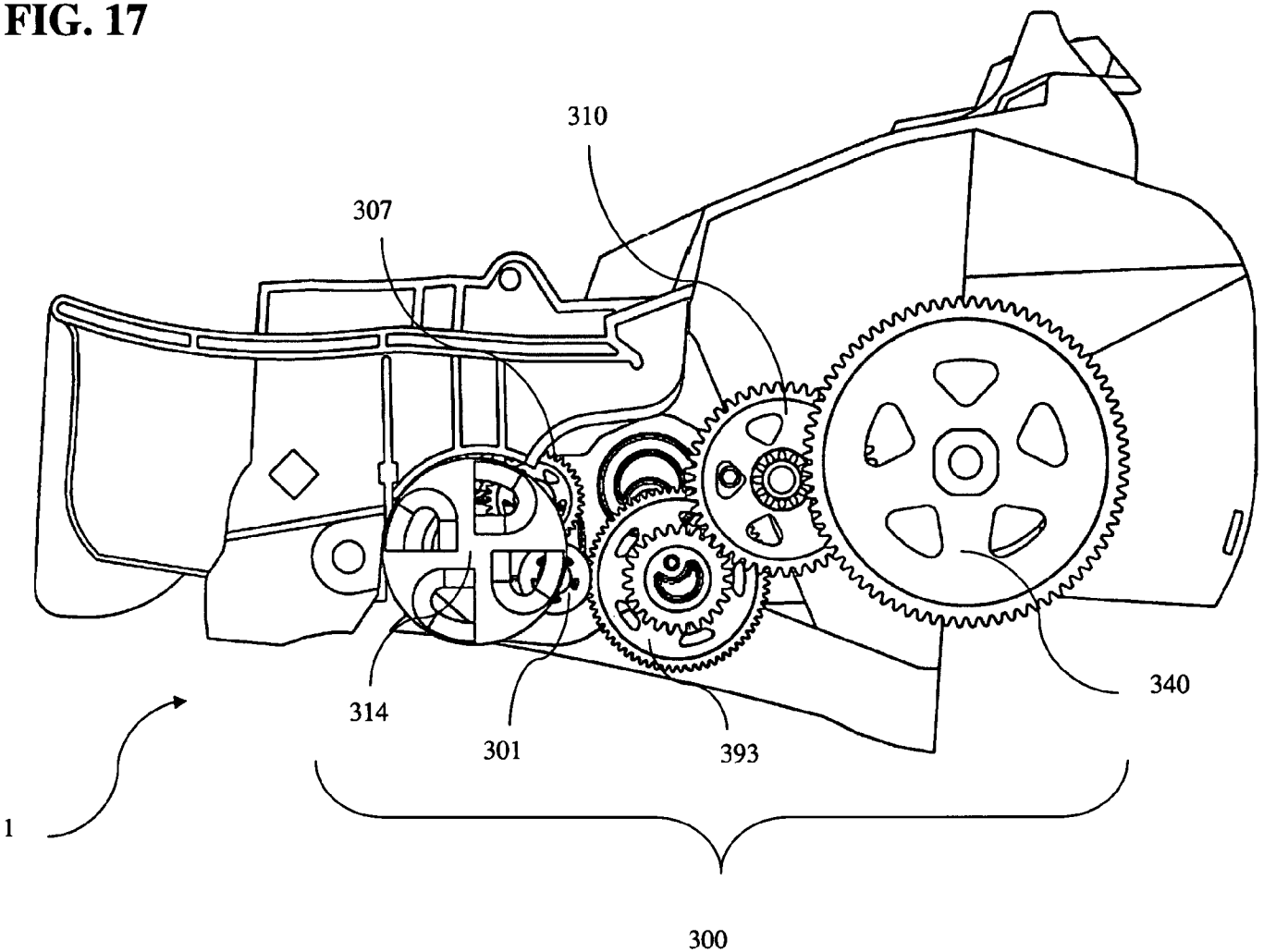
FIG. 17 is an elevated view of the gear train of one embodiment of the inventive apparatus.
Figure 18:
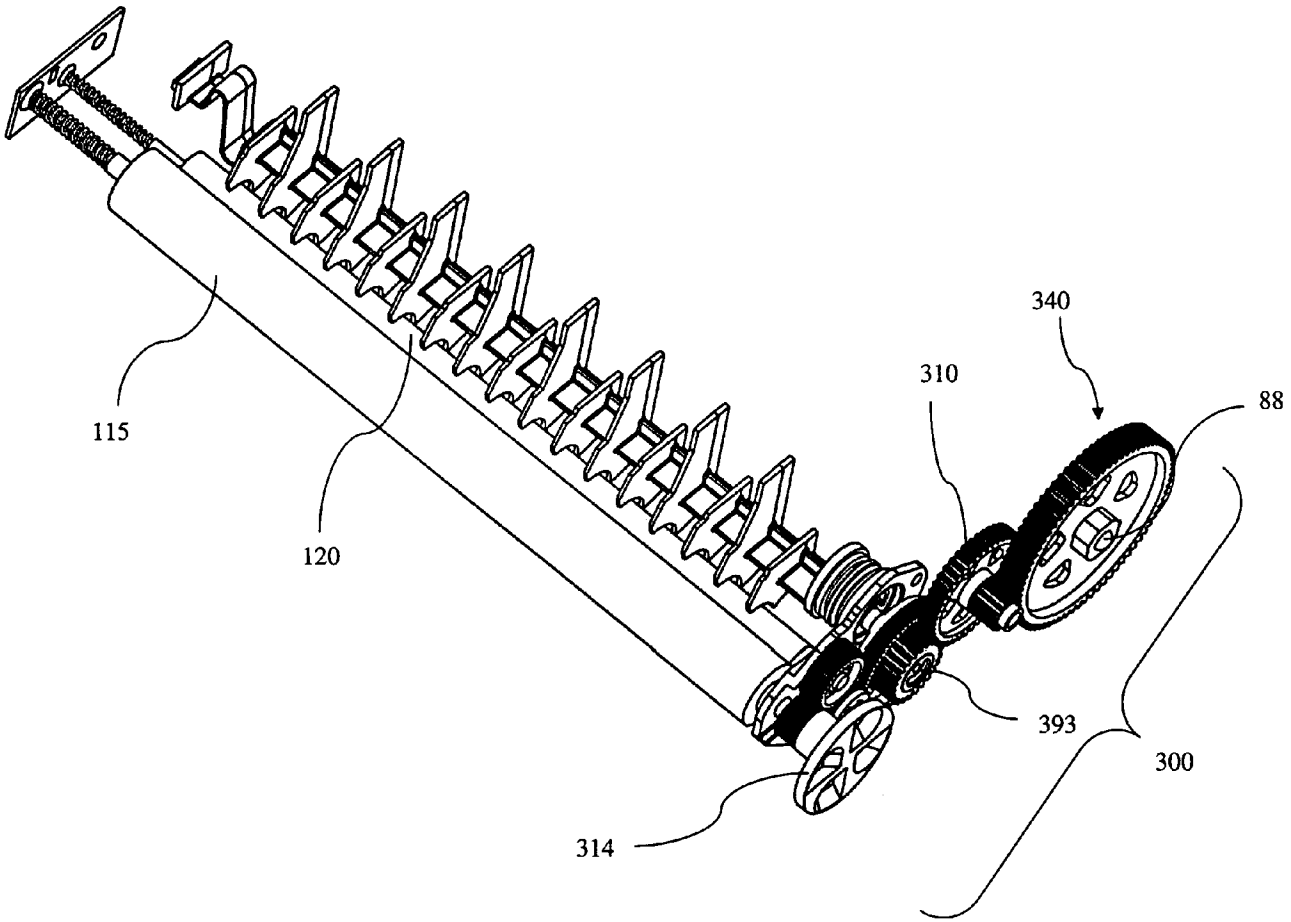
FIG. 18 is a perspective view of the inter-relation of the sifting agitator, conforming seals, toner adder roller, gear plate, developer roller, and gear train.

Turning now to FIGS. 17 and 18, drive train 300, which is deigned to operate the sifting agitator discussed supra and forms a part of novel toner cartridge 1, includes drive dog 314, which is integral to developer roller 115, idler gear 307, adder roller gear 301, which is integral to toner adder roller 120, compound cam gear 393, compound idler gear 310, and beater drive gear 340.

Drive dog 314 integral with the end of the developer roller receives rotational force from a drive means in the printer when novel toner cartridge 1 is installed in the printer. Drive dog 314 is integral with developer roller 115 and drives idler gear 307, which drives toner adder roller 120 by being meshed with gear 301 which is integral with toner adder roller 120.

Figure 20A:
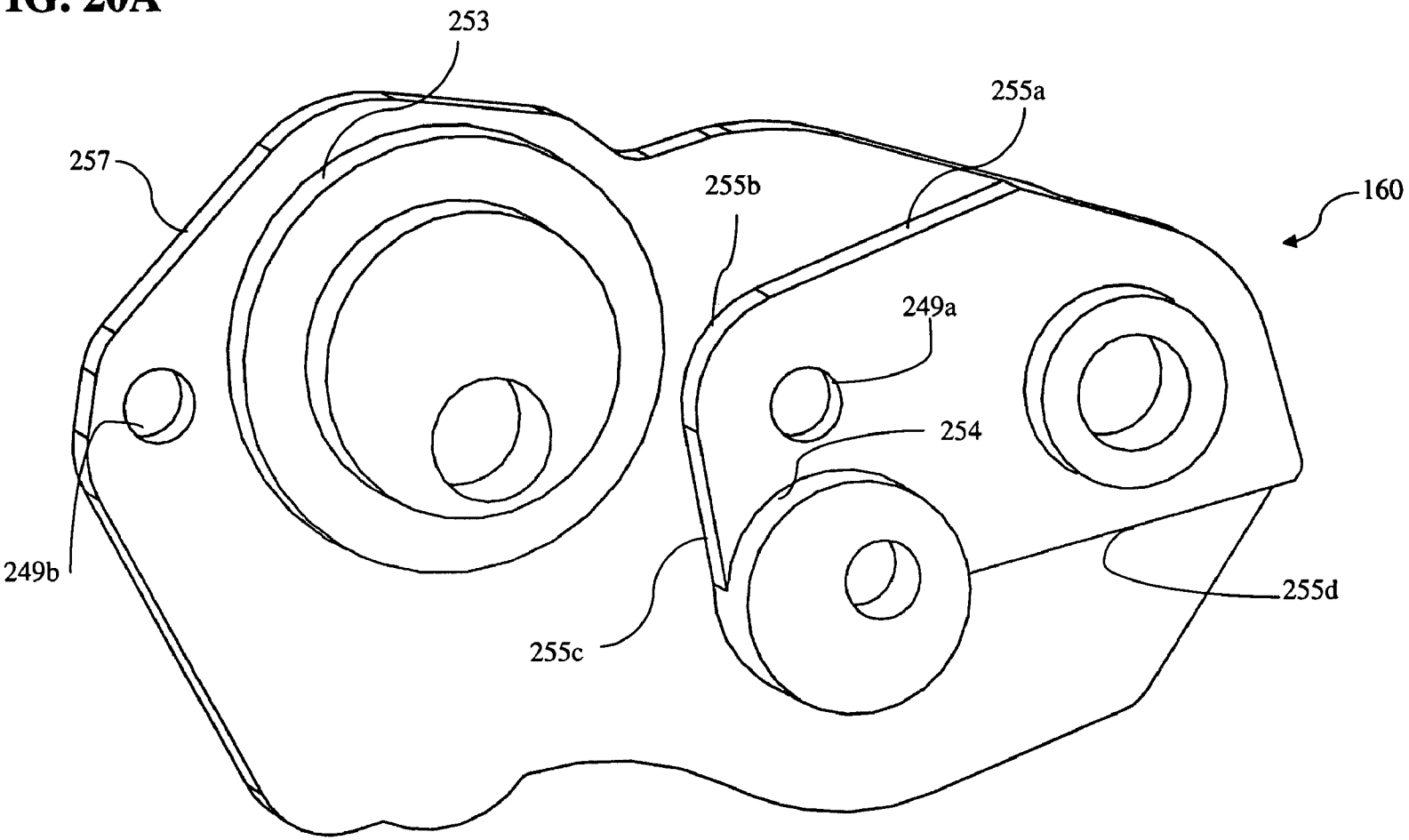
FIG. 20A is a side perspective view of the gear plate.
Figure 20B:
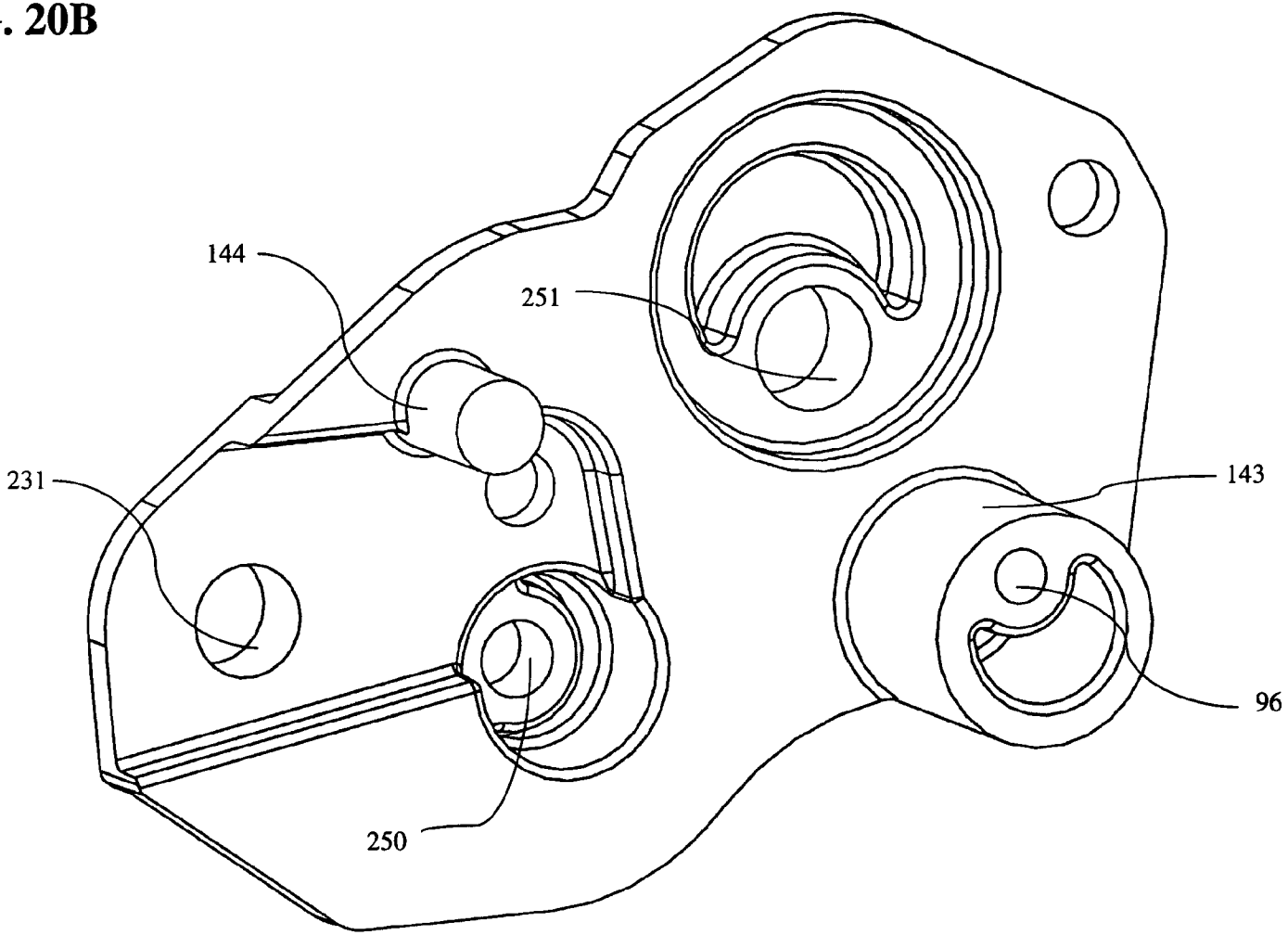
FIG. 20B is a side perspective view of the gear plate.

Gear plate 160 (FIGS. 20A and 20B) is attached to novel toner cartridge 1 which receives raised areas 254, 253, and 255*a-d*. Screw holes 249*a/b* align with holes on novel toner cartridge 1 and receive screws to affix gear plate 160 thereto.

Developer roller shaft 115 bears on developer roller bearing surface 231 and extends through gear plate 160. Drive dog 314 is then attached to extended portion of the developer roller shaft 115 becoming integral therewith. Similarly, the shaft of toner adder roller 120 bears on support bearing hole 250 and extends through gear plate 160. Adder roller gear 301 attaches to the extended portion of the shaft of toner adder roller 120, becoming integral therewith. Spacer 398 can be added to adder roller gear 301 to contact drive dog 314 which prevents adder roller gear 301 from becoming displaced (FIG. 15).

Cam pin 220 of sifting agitator 200 penetrates, and extends through hole 251 of gear plate 160, the rounded tip thereof contacting the cam surface of compound cam gear 393 to displace sifting agitator 200 as discussed supra.

As discussed, compound cam gear 393 turns on compound cam gear shaft 143. Compound cam gear shaft 143 receives a screw in screw hole 96 to retain the compound cam gear in place. The screw is important since cam pin 220 exerts force against compound cam gear 393. Compound cam gear 393 has a thickened shaft to withstand the stress applied by the sifting agitator contacting the back of the cam gear.

Figure 19A:
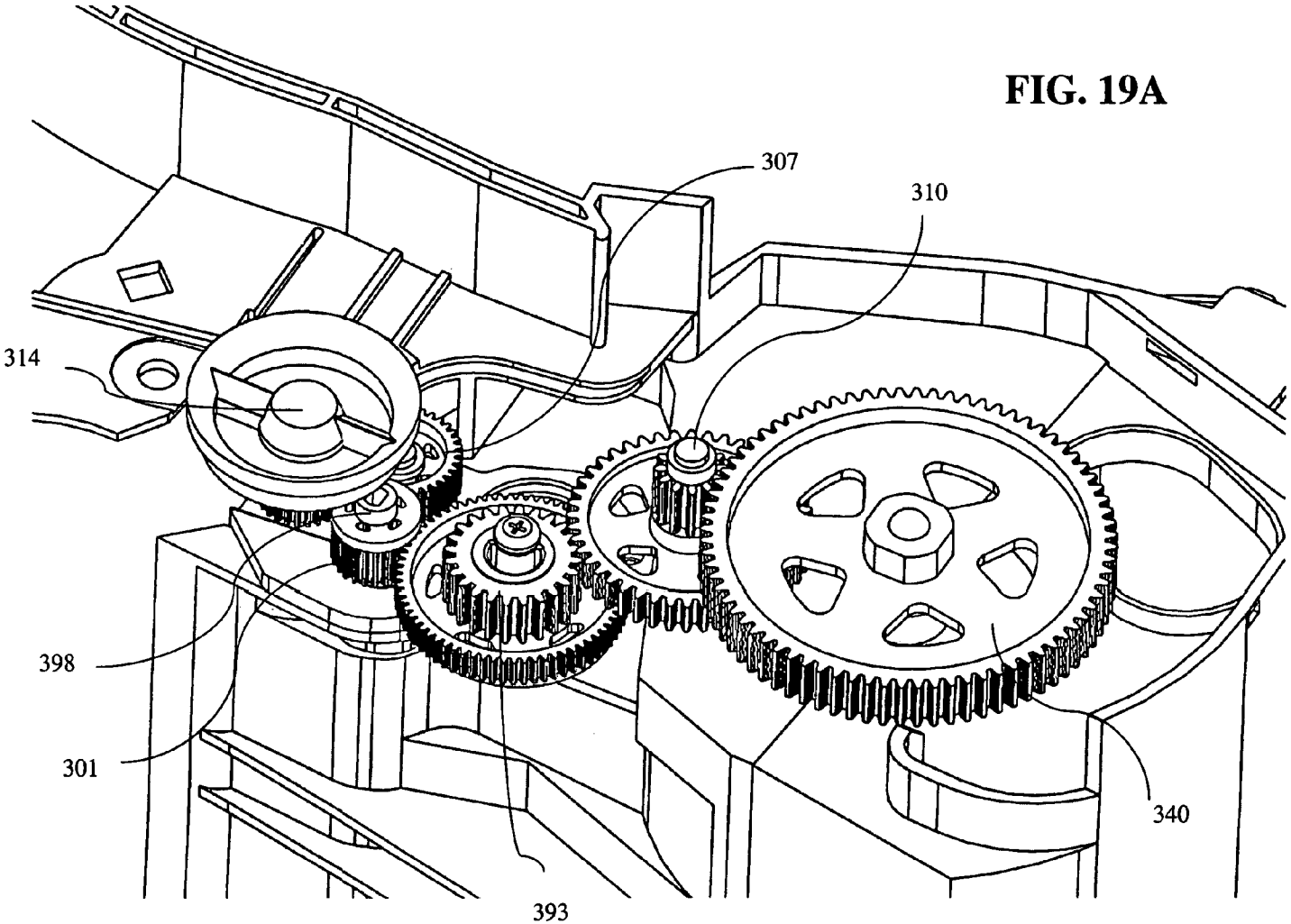
FIG. 19A is a perspective view of the gear train of the inventive toner cartridge.
Figure 19B:
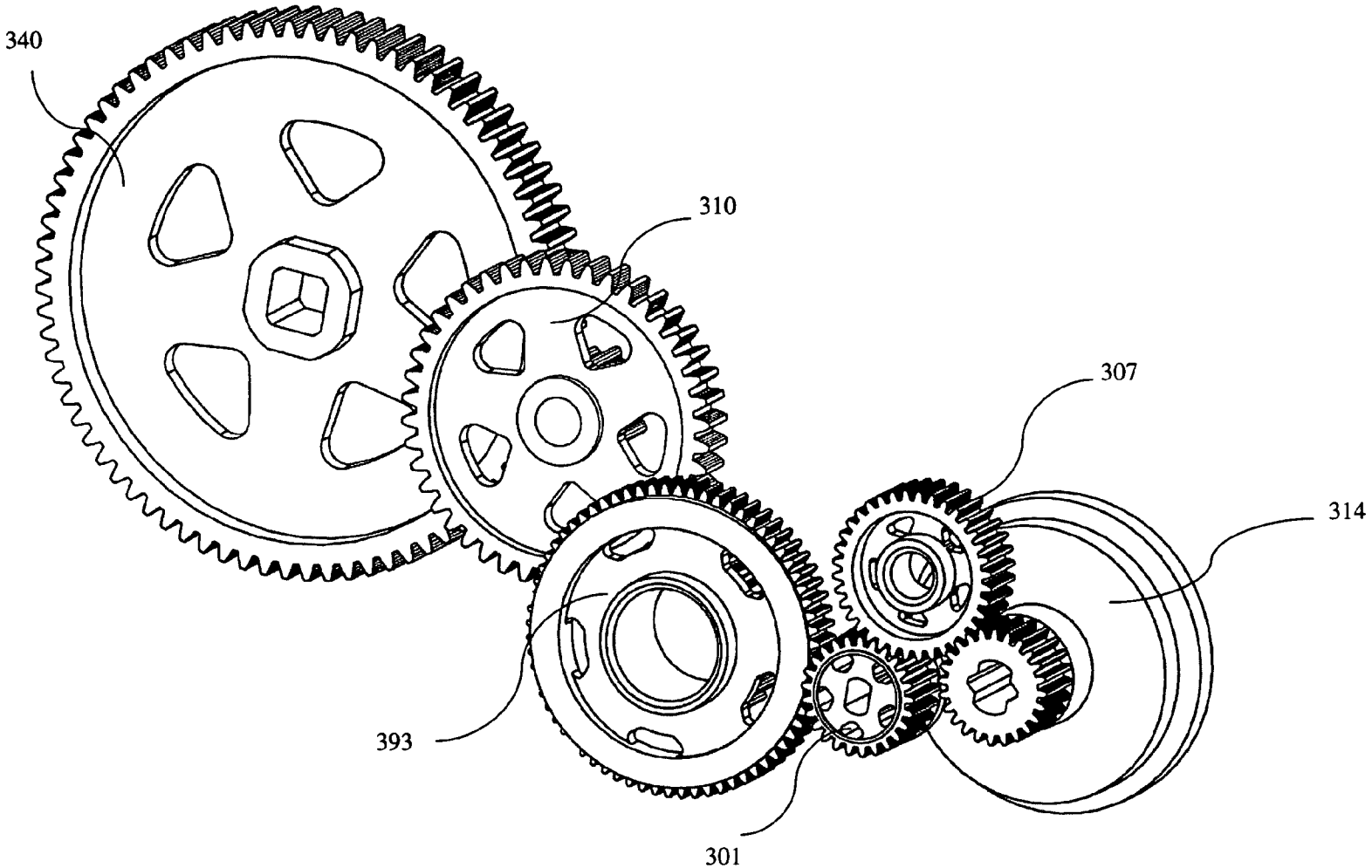
FIG. 19B is an alternate perspective view of the gear train of the inventive toner cartridge.

Idler gear 307 turns on shaft 144 (FIG. 20B) and is retained by the teeth of adder roller gear 301 and the non-toothed area of drive dog 314 (FIG. 19B). Compound idler gear 310 turns on a shaft integral with the hopper.

Beater drive gear 340 engages and becomes integral with the shaft of the toner beating and sensing apparatus and has protrusion 88 (FIG. 18) that contacts the inside wall of waste bin 2 which keeps beater drive gear 340 in place. In one embodiment, beater drive gear 340 has a diameter larger than that of the prior art to facilitate the toner beating apparatus therein.

Drive Dogs

Figure 21B:
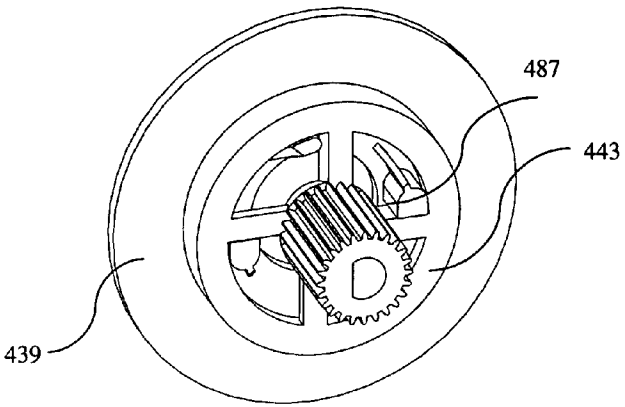
FIG. 21B Prior Art
FIGS. 21A-21C are perspective views of the drive dog and printer drive means of the prior art.
Figure 21C:
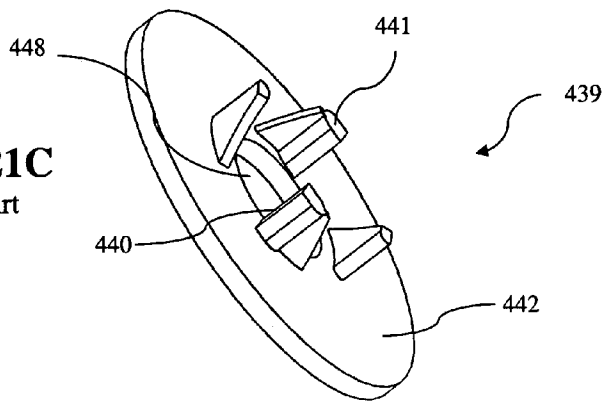
FIG. 21C Prior Art
Figure 21A:
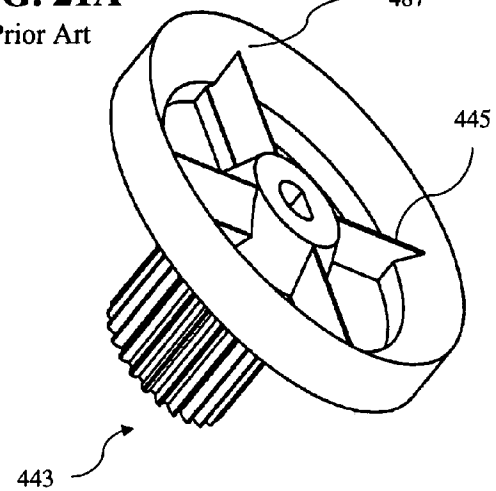
FIG. 21A Prior Art

When the spoked drive dogs of the prior art 443 (FIGS. 21A-C) engage with the printer drive mechanism of the printer, leading edge of seat 445 of the prior art drive dog 443 does not contact flat surface 442 (FIG. 21C) of the printer drive mechanism, that is it does not fully engage, causing gap 487. This condition causes excessive wear and catastrophic cartridge failure. The drive dogs of the present invention fully engage the drive teeth of the printer drive mechanism as shown hereafter.

Figure 22A:
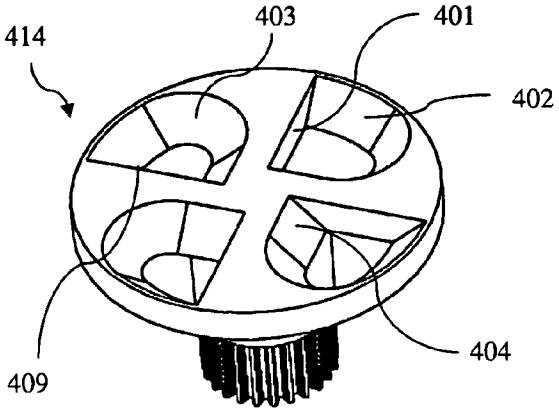
FIGS. 22A-22E are perspective views of the drive dogs of the inventive apparatus.

Drive dog 414, FIG. 22A, has a tapered outboard tooth guide 402, tapered radius tooth guide 403, and tapered inboard tooth guide 404 which center and direct tooth 441 of the printer drive mechanism 439 into drive dog seat 401. Leading edge surface 409 contacts surface 442 of the printer drive mechanism 439 allowing full contact between drive dog seat 401 and drive tooth contact surface 440.

Figure 22B:
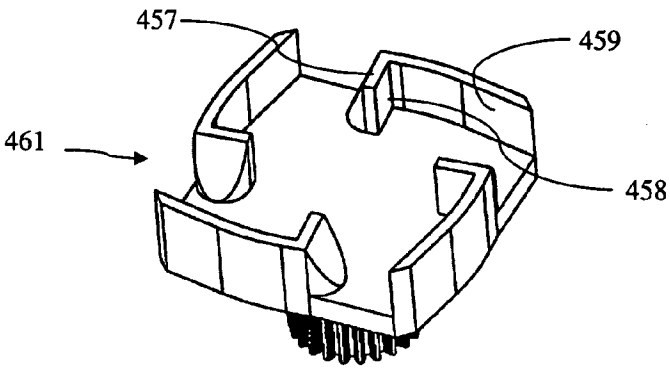

Drive dog 461, FIG. 22B, has an external ramp 459 to direct tooth 441 of the printer drive mechanism 439 into drive seat 458. Leading edge 457 of drive seat 458 contacts flat surface 442 of printer drive mechanism 439 thus making full contact with the entire drive tooth/drive contact surface 440.

Figure 22C:
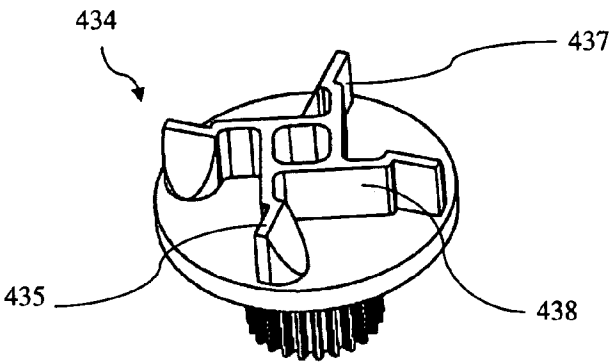

Drive dog 434, FIG. 22C, has internal ramp 438 to direct tooth 441 of the printer drive mechanism into drive seat 437. The leading edge 435 of drive seat 437 contacts flat surface 442 of the printer drive mechanism thus making full contact with the entire drive tooth/drive contact surface 440.

Figure 22D:
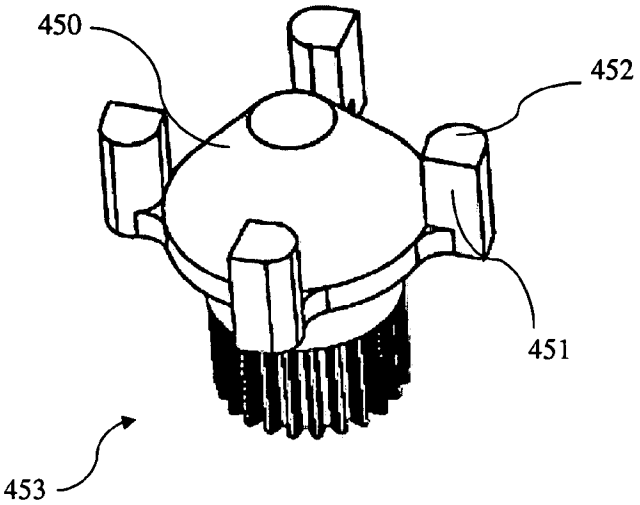

Drive dog 453, FIG. 22D has centering cone 450 which locates in hole 448 of the printer drive mechanism to capture tooth 441 of drive mechanism 439 against drive seat 451. Leading edge 452 of drive seat 451 contacts flat surface 442 of printer drive mechanism 439 thus making full contact with the entire drive tooth/drive contact surface 440.

Figure 22E:
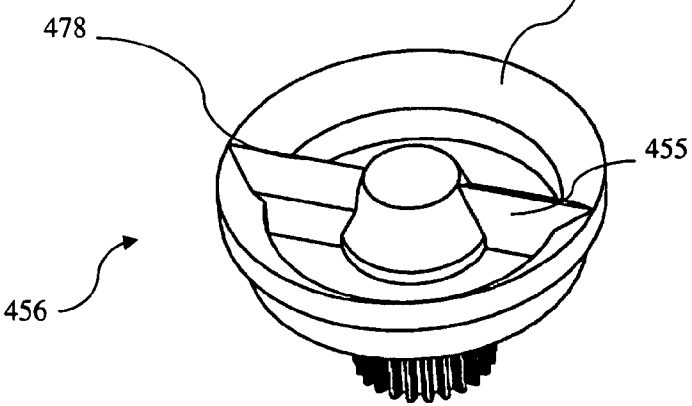

Drive dog 456, FIG. 22E, seats tooth 441 of printer drive mechanism 439 into drive seat 455. Leading edge 478 of drive seat 455 contacts flat surface 442 of printer drive mechanism 439 thus making full contact with the entire drive tooth/drive contact surface 440. Leading edge of tapered tooth guide 479, which is outboard of drive seat 455, funnels in and centers tooth 441 of printer drive mechanism 439.

Photoconductive Drum Shaft

The photoconductive drum of the prior art is installed into the cartridge by placing the drum and corresponding gears in position with a thin washer on one side, then inserting a metal shaft through the cartridge and drum assembly. Standard E-clips are installed on each end of the shaft to hold the drum and shaft from lateral movement. Such assembly is complicated and requires that all components be aligned perfectly in order for the shaft to be successfully threaded throughout the assembly.

One embodiment of the novel photoconductive drum shaft assembly uses an electrically conductive plastic photoconductive drum shaft inserted through support holes until the integrated raised washer of drum shaft contacts the outer side wall of waste bin 2. Once in place, a retaining push nut is slid over the end of drum shaft to lock it in place. The protruding tip of shaft serves to locate the cartridge in the printer and communicates electricity between the photoconductive drum and the printer via a contact in the printer.

Figure 23A:
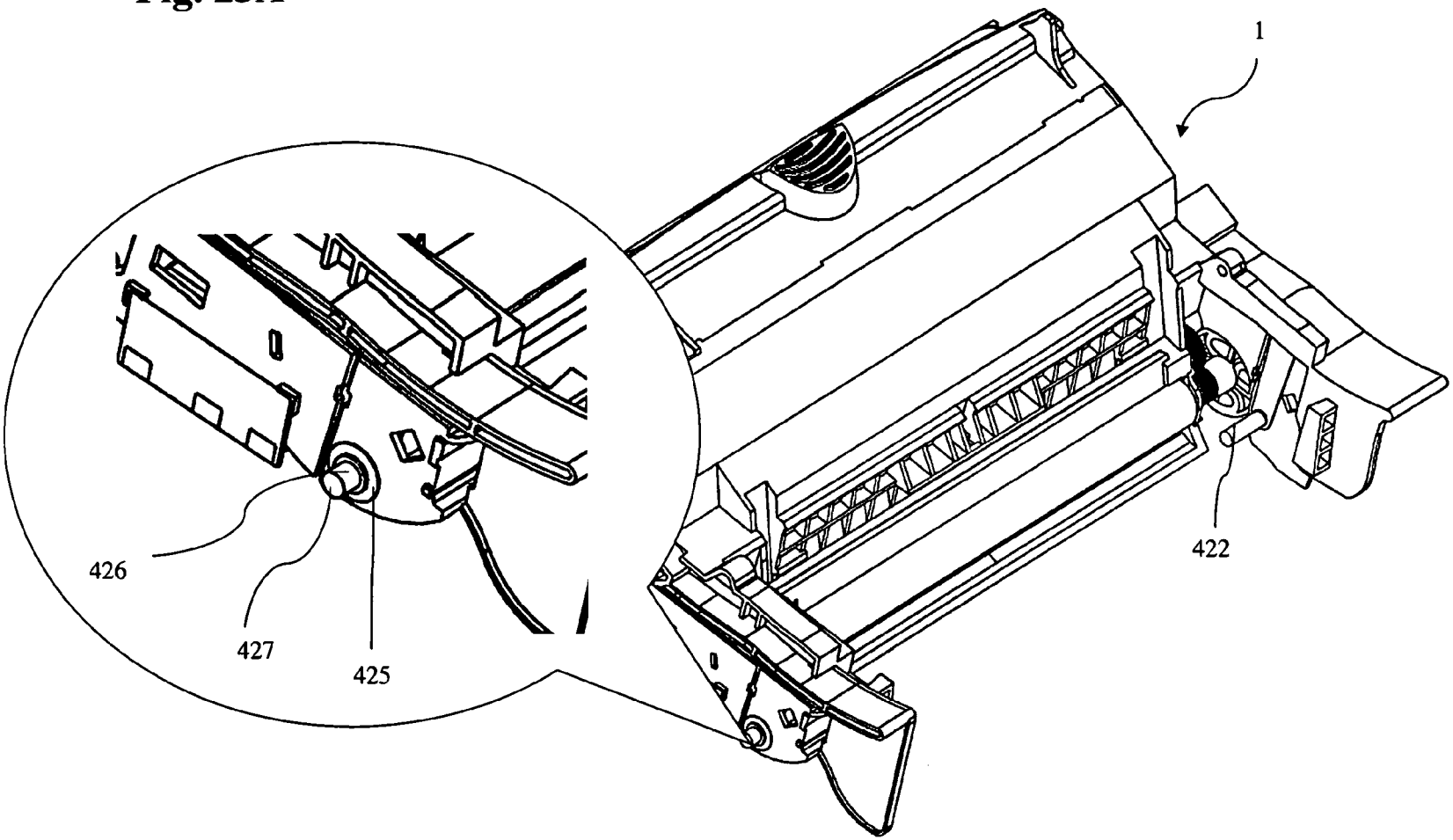
FIGS. 23A-23C are perspective views of the photoconductive drum studs of the novel toner cartridge.
Figure 23B:
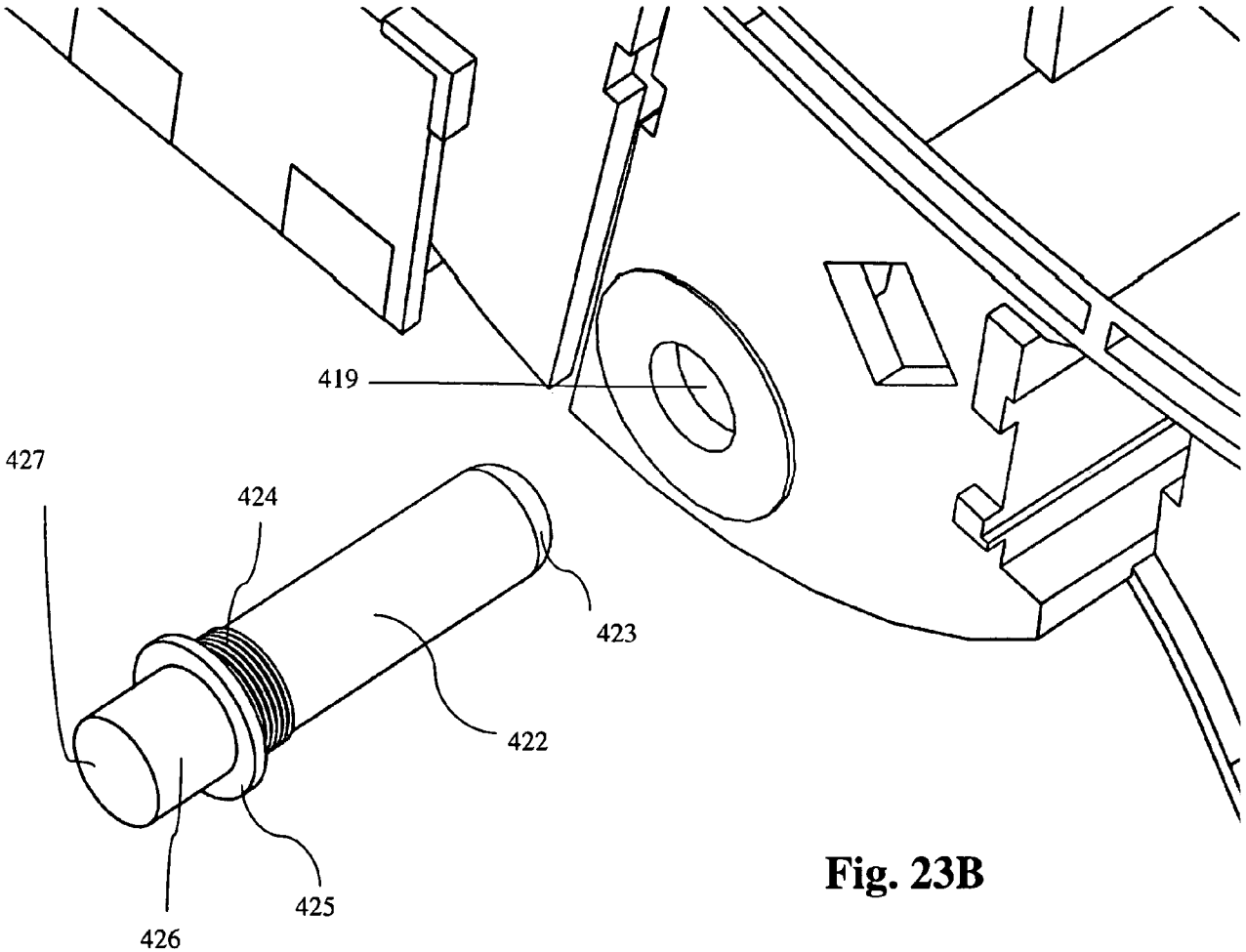
Figure 23C:
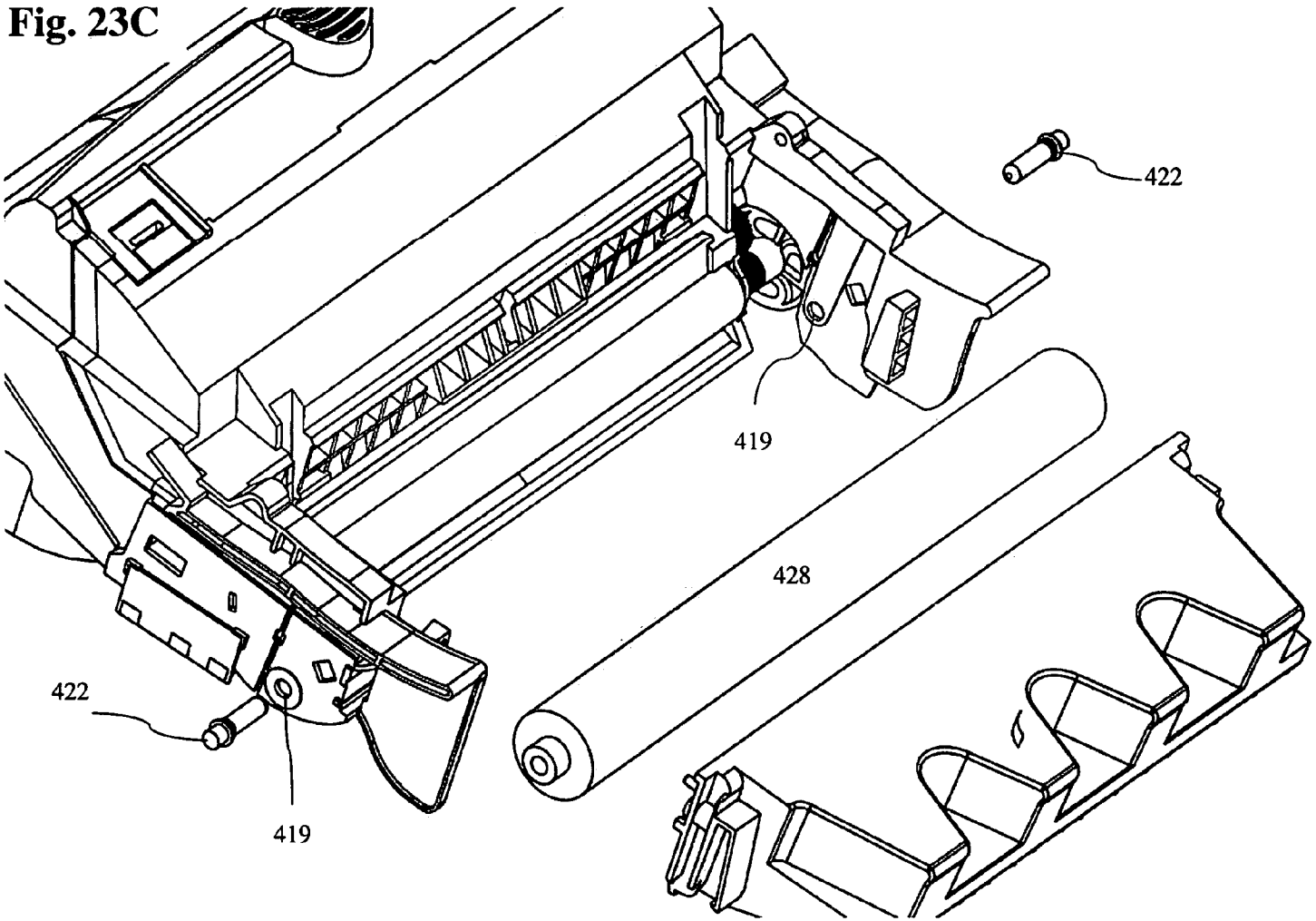

In an alternate embodiment, FIGS. 23A-C, the photoconductive drum shaft is replaced by a pair of drum studs 422. Drum studs 422 screw into shaft support hole 419. Depth limiting washers 425 contact the outer side walls of waste bin 2 to properly locate studs 422. Once inserted into the printer, stud surfaces 426 act to locate the cartridge in the printer and electrically communicate with the photoconductive drum via a contact in the printer. Threads 424 are right-handed for one side of waste bin 2 and left-handed for the opposite side. This counter-threading ensures that as the photoconductive drum spins, studs 422 are continuously rotated in a direction that tightens them against waste bin 2. In an alternate embodiment, studs 422 are over-sized in diameter which creates a snug fit in the photoconductive drum bushing. In such a manner, the need for a harmonic dampening device is obviated.

Photoconductive Drum Door

Figure 24A:
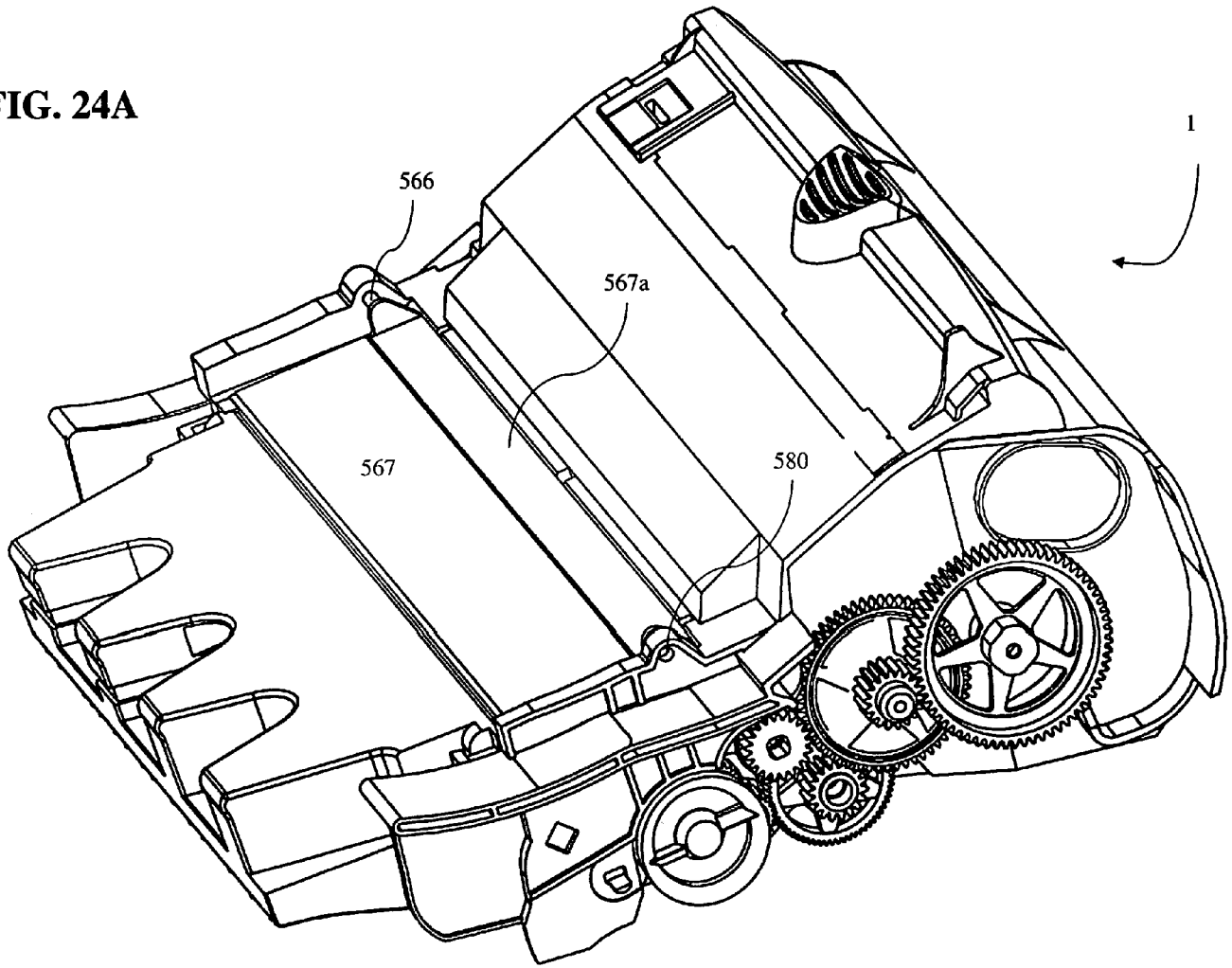
FIGS. 24A and 24B are perspective views of the light blocking door of the inventive apparatus.
Figure 24B:
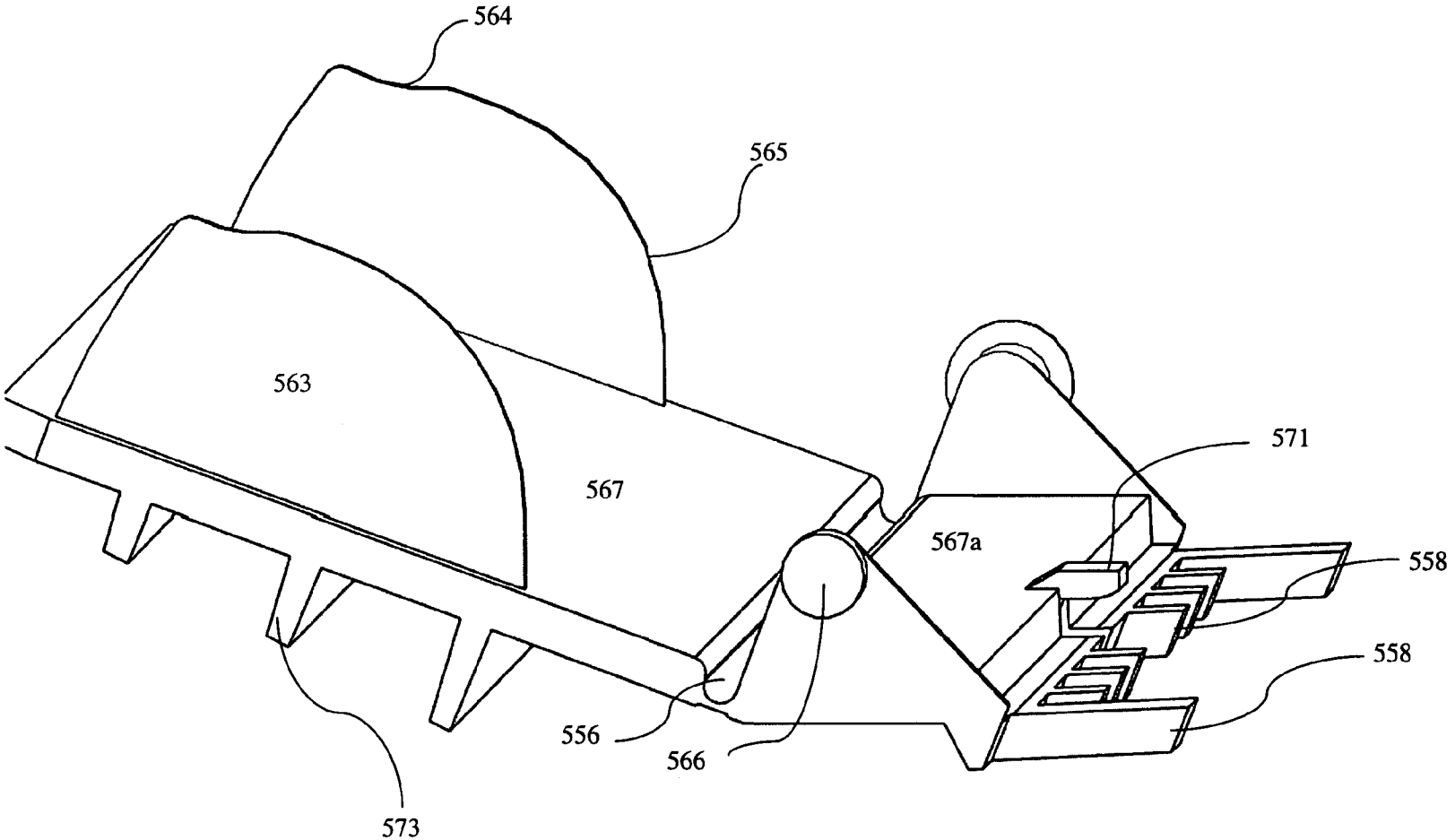

To protect photoconductive drum 428 from exposure to light when novel toner cartridge 1 is not in use, protecting door 567, FIGS. 24A and B, is disposed within waste bin 2. Attaching posts 566 of door 567 mate with holes 580 disposed within waste bin 2. Upper tab 571 and lower flanges 558 secure above and below a shelf on waste bin 2. In this manner stationary member 567*a* of door 567 is locked in position.

Structural support ribs 573 provide strength to door 567. This embodiment obviates the need for a torsion spring, or other biasing means, to return the door to its position of repose, the closed position, as is required by the toner cartridges of the prior art.

In operation, a mechanism within the printer lowers to contact depression 564 disposed on door protrusions 563. The mechanism within the printer slides against the radius 565 of protrusions 563 causing door 567 to open as it bends on flexible member 556, i.e. a pliable hinge having memory characteristics.

It will be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. A drive dog for use with an imaging cartridge adapted to mate with an imaging machine drive mechanism within an imaging cartridge-receiving cavity of an imaging machine, comprising:

at least one drive dog seat disposed along an axis of the drive dog adapted to receive a tooth of the imaging machine drive mechanism;

the leading edge of said drive dog seat being the leading edge of said drive dog such that the drive dog seat contacts the base surface of said imaging machine drive mechanism and fully engages said tooth of said imaging machine drive mechanism; and a tapered tooth guide outboard of said drive dog seat whereby said tooth of the imaging machine drive mechanism is centered and directed into the drive dog seat.

2. The drive dog of claim 1, further comprising;

a tapered surface inboard of said drive dog seat whereby said tooth of the imaging machine drive mechanism is centered and directed into the drive dog seat.

3. A drive dog for use with an imaging cartridge adapted to mate with an imaging machine drive mechanism within an imaging cartridge-receiving cavity of an imaging machine, comprising:

at least one drive dog seat disposed along an axis of the drive dog adapted to receive a tooth of the imaging machine drive mechanism; and a locating cone extending beyond the leading edge of said drive dog seat;

said locating cone adapted to locate in the hole of the imaging machine drive mechanism whereby said tooth of the imaging machine drive mechanism is centered and directed into the drive dog seat.

* * * * *

UNITED STATES PATENT AND TRADEMARK OFFICE

CERTIFICATE OF CORRECTION

PATENT NO. : 7,565,097 B2
APPLICATION NO. : 12/043902
DATED : July 21, 2009
INVENTOR(S) : Steven Miller It is certified that error appears in the above-identified patent and that said Letters Patent is hereby corrected as shown below:

On patent cover page item (60) under Related U.S. Application Data, Line 5, before "of application", insert -- in part --

In Specification, Column 1, Line 13, after "continuation", insert -- in part --

Signed and Sealed this

Seventeenth Day of August, 2010

David J. Kappos

David J. Kappos
*Director of the United States Patent and Trademark Office*